US009453178B2

(12) United States Patent
McCreery

(10) Patent No.: US 9,453,178 B2
(45) Date of Patent: Sep. 27, 2016

(54) CORROSION-INHIBITING LUBRICANT AND METHODS THEREFOR

(76) Inventor: David McCreery, Sunset Hills, MO (US)

( * ) Notice: Subject to any disclaimer, the term of this patent is extended or adjusted under 35 U.S.C. 154(b) by 331 days.

(21) Appl. No.: 14/235,328

(22) PCT Filed: Jul. 25, 2012

(86) PCT No.: PCT/US2012/048067
§ 371 (c)(1),
(2), (4) Date: Jan. 27, 2014

(87) PCT Pub. No.: WO2013/016387
PCT Pub. Date: Jan. 31, 2013

(65) Prior Publication Data

US 2014/0162913 A1 Jun. 12, 2014

Related U.S. Application Data

(60) Provisional application No. 61/511,340, filed on Jul. 25, 2011.

(51) Int. Cl.
*C10M 141/10* (2006.01)
*B65D 83/14* (2006.01)
*C10M 169/04* (2006.01)

(52) U.S. Cl.
CPC ..... *C10M 141/10* (2013.01); *B65D 83/752* (2013.01); *C10M 169/04* (2013.01); *C10M 2201/041* (2013.01); *C10M 2201/12* (2013.01); *C10M 2203/1006* (2013.01);

(Continued)

(58) Field of Classification Search
CPC ..... C10N 2050/04; C10N 2230/12; C10N 2250/04
See application file for complete search history.

(56) References Cited

U.S. PATENT DOCUMENTS 4,428,851 A * 1/1984 Hisamoto ..... C10M 111/00 508/579
5,861,349 A 1/1999 Klimov et al.

(Continued)

FOREIGN PATENT DOCUMENTS

EP 1385926 2/2004
EP 2270121 1/2011

(Continued)

OTHER PUBLICATIONS

WD-40 Company, WD-40 Material Safety Data Sheet, Date of Preparation Mar. 11, 2010, Revision Date Mar. 2010, pp. 1-4, San Diego, California, United States of America.

(Continued)

*Primary Examiner* — Ellen McAvoy
(74) *Attorney, Agent, or Firm* — Saul L. Zackson; Zackson Law LLC

(57) ABSTRACT

Disclosed are corrosion-inhibiting lubricant compositions and methods of making and using the compositions. The lubricant compositions contain petroleum based components, corrosion-inhibiting additives and a cationic surfactant. In some embodiments, the lubricant compositions also contain nano diamonds. Under standard salt fog tests, compositions exhibited 120 or 168 hours to failure, or 0-20% rust at 192 hours. Under standard wear preventative characteristics tests, compositions exhibited as low as 0.55 mm wear. Also disclosed are a device and method for aerosol delivery of a corrosion-inhibiting lubricant.

20 Claims, 7 Drawing Sheets

(52) U.S. Cl.
CPC . *C10M 2203/1065* (2013.01); *C10M 2205/12* (2013.01); *C10M 2207/12* (2013.01); *C10M 2207/122* (2013.01); *C10M 2207/126* (2013.01); *C10M 2211/022* (2013.01); *C10M 2211/024* (2013.01); *C10M 2215/04* (2013.01); *C10M 2215/223* (2013.01); *C10M 2219/044* (2013.01); *C10M 2219/106* (2013.01); *C10M 2223/04* (2013.01); *C10M 2223/043* (2013.01); *C10N 2220/082* (2013.01); *C10N 2230/06* (2013.01); *C10N 2230/12* (2013.01); *C10N 2250/04* (2013.01)

(56) References Cited

U.S. PATENT DOCUMENTS

| | | | | |
|---|---|---|---|---|
| 5,916,955 | A | 6/1999 | Vereschagin et al. | |
| 6,486,103 | B1 * | 11/2002 | Burdzy | C10M 111/04 508/582 |
| 6,919,300 | B2 * | 7/2005 | Dituro | C10M 169/04 508/273 |
| 7,578,372 | B1 | 8/2009 | Green | |
| 8,598,098 | B2 * | 12/2013 | Nakagawa | B82Y 30/00 508/128 |
| 8,728,994 | B2 * | 5/2014 | Ohira | B21J 3/00 508/110 |
| 9,023,771 | B2 * | 5/2015 | Mabuchi | C10M 169/04 508/113 |
| 2004/0186026 | A1 | 9/2004 | Hyde | |
| 2004/0242440 | A1 * | 12/2004 | Okuda | C10M 135/00 508/567 |
| 2005/0272614 | A1 * | 12/2005 | Walker | C10M 141/10 508/232 |
| 2006/0191819 | A1 * | 8/2006 | Haines | C10M 101/02 208/19 |
| 2007/0027037 | A1 * | 2/2007 | Easter | C10M 105/50 508/181 |
| 2009/0036333 | A1 * | 2/2009 | Scholier | C10M 107/02 508/110 |
| 2009/0036338 | A1 * | 2/2009 | Hee | C10M 107/02 508/506 |
| 2010/0029518 | A1 | 2/2010 | Markovitz et al. | |
| 2011/0257316 | A1 * | 10/2011 | Wuerch | C08L 53/00 524/271 |

FOREIGN PATENT DOCUMENTS

| | | |
|---|---|---|
| RU | 2198911 | 2/2003 |
| SU | 503896 | 2/1976 |
| SU | 1838208 | 8/1993 |

OTHER PUBLICATIONS

JACAAB LLC, JACAAB-Duomeen TDO Material Safety Data Sheet# J00530700_052805, Validation Date May 28, 2005, pp. 1-6, St. Louis, Missouri, United States of America.

King Industries Inc, K-CORR (R) NF-200 Product Data Sheet, pp. 1-2, Revision Date Aug. 20, 2008, Norwalk, CT, United States of America.

King Industries Inc, NA-LUBE (R) AW-6110 Product Data Sheet, pp. 1-2, Revision Date Jul. 29, 2004, Norwalk, CT, United States of America.

King Industries Inc, Lubricant Additives Division; Specialty Additives and Synthetic Base Oils for Industrial & Automotive Lubricants, Greases, Metalworking Fluids and Rust Preventives, pp. 1-52, Mar. 2012, Norwalk, CT, United States of America.

King Industries Inc, High Performance Products for Coatings, Inks, Adhesives and Sealants, pp. 1-39, Oct. 2006, Norwalk, CT, United States of America.

* cited by examiner

CORROSION-INHIBITING LUBRICANT AND METHODS THEREFOR

CROSS-REFERENCE TO RELATED APPLICATIONS

This application claims priority from PCT application No. PCT/US2012/048067 filed Jul. 25, 2012 and U.S. Provisional Application Ser. No. 61/511,340 filed on Jul. 25, 2011, each of which is incorporated herein by reference in its entirety.

INTRODUCTION

The present teachings relate to corrosion-inhibiting compositions and, in particular, to lubricating compositions that inhibit metal corrosion.

Corrosion due to interaction of metals with the environment is a common problem that is exemplified in the corrosion of iron in the process of rusting. The consequences of corrosion can be a deterioration of appearance and a weakening of metal that can result in a failure or breakdown in the metal structure and ultimately its function. Lubricants are commonly used to reduce friction between moving metal parts and good quality lubricants are often formulated with additives to help reduce the formation of metal corrosion and rust. Nevertheless, metal corrosion and rust can still occur and there remains a continuing need for new lubricant compositions that also show superior corrosion-inhibiting properties.

SUMMARY

Accordingly, the present inventors have succeeded in devising corrosion-inhibiting lubricant compositions. Thus, in various embodiments, the present teachings include disclosure of a lubricant composition that includes a) about 15 to about 25 wt % of a mineral oil; b) about 17 to about 27 wt % of a petroleum hydrocarbon; c) about 5 to about 15 wt % of a liquid wax; d) about 40 to about 50 wt % of a halogenated organic solvent; e) about 0.5 to about 1.5 wt % of phosphoric acid esters; f) about 0.05 to about 0.15 wt % of a metal deactivator; and g) about 0.05 to about 1.5 wt % or about 0.05 to about 6.0 wt % of a cationic surfactant. In various configurations, the lubricant composition may further include h) about 1 to about 10 wt % of a nano diamond component. In various embodiments, a halogenated organic solvent can be perchloroethylene or parachlorobenzotrifluoride (PCBTF).

Lubricant compositions of the present teachings can have corrosion-inhibiting properties such that they can displace moisture, inhibit rust formation and provide lubrication. The compositions are silicone-free and they can be ideal for numerous applications including, but not limited to industrial applications, e.g., in paint shops or industrial plants, automotive and motorcycle applications, farm and heavy equipment applications, marine applications, household applications, electrical and power tool applications, firearm applications as well as sports and recreational applications.

In various embodiments, the present teachings also include methods of making a lubricant composition. The method includes blending together a) about 15 to about 25 wt % of a mineral oil; b) about 17 to about 27 wt % of a petroleum hydrocarbon; c) about 5 to about 15 wt % of a liquid wax; d) about 40 to about 50 wt % of a halogenated organic solvent; e) about 0.5 to about 1.5 wt % of phosphoric acid esters; f) about 0.05 to about 0.15 wt % of a metal deactivator, and g) about 0.05 to about 1.5 wt % or about 0.05 to about 6.0 wt % of a cationic surfactant. In various configurations, the method may further include blending with components a)-g) the additional component h) of about 1 to about 10 wt % of a nano diamond component. In various configurations, lubricant compositions made by these methods can have corrosion-inhibiting properties.

The present teachings, in various embodiments, further include methods of providing lubrication and corrosion protection to an apparatus such as a machine or mechanism having moving metal pans. Some configurations of the methods comprise providing a lubricating composition that includes a) about 15 to about 25 wt % of a mineral oil; b) about 17 to about 27 wt % of a petroleum hydrocarbon; c) about 5 to about 15 wt % of a liquid wax; d) about 40 to about 50 wt % of a halogenated organic solvent; e) about 0.5 to about 1.5 wt % of phosphoric acid esters; f) about 0.05 to about 0.15 wt % of a metal deactivator; and g) about 0.05 to about 1.5 wt % or about 0.05 to about 6.0 wt % of a cationic surfactant and applying the composition to the apparatus. In various configurations, the lubricating composition may further include h) about 1 to about 10 wt % of a nano diamond component. In various aspects, these methods can provide lubrication and corrosion protection by virtue of the lubricant composition having corrosion-inhibiting properties.

In yet another embodiment, the present teachings includes an apparatus containing a corrosion-inhibiting lubricant composition for aerosol delivery. The apparatus includes a container, a lubricant composition contained therein and an actuating valve for discharging the composition in the container in an aerosol form. In various aspects of the present teachings, the corrosion-inhibiting lubricant composition includes a) about 15 to about 25 wt % of a mineral oil; b) about 17 to about 27 wt % of a petroleum hydrocarbon; c) about 5 to about 15 wt % of a liquid wax; d) about 40 to about 50 wt % of a halogenated organic solvent; e) about 0.5 to about 1.5 wt % of phosphoric acid esters; f) about 0.05 to about 0.15 wt % of a metal deactivator; and g) about 0.05 to about 1.5 wt % or about 0.05 to about 6.0 wt % of a cationic surfactant. In various configurations, the lubricating composition may further include h) about 1 to about 10 wt % of a nano diamond component.

The lubricant compositions in various aspects of the embodiments described above can include, but are not limited to a composition in which a) the mineral oil includes a hydrotreated heavy naphthenic distillate, b) the petroleum hydrocarbon includes a kerosene, c) the liquid wax includes a mixture of at least one calcium alkylarylsulfonate, at least one calcium carboxylate and a plurality of petroleum oxidates, d) the halogenated organic solvent includes parachlorobenzotrifluoride (PCBTF) or perchloroethylene, e) the phosphoric acid esters include amine salts of aliphatic phosphoric acid esters, f) the metal deactivator includes a benzotriazole metal deactivator, and g) the cationic surfactant includes an N-tallow alkyl-1,3-diaminopropane dioleate surfactant. The composition may further include h) a nano diamond component in which the nano diamonds have an average diameter of from about 4 to about 6 nanometers (nm).

In some embodiments, a lubricant of the present teachings can be a Multi-Purpose Lubricant. In various aspects, properties of a lubricant of the present teachings can include the following:

A lubricant of the present teachings can be a moisture repellent. In various configurations, it can be used for protecting and removing moisture from wet ignition systems on motorcycles, marine engines and electric motors. In some configurations, a lubricant can overcome and prevent stubborn starting and stalling in damp climates and heavy downpours.

The penetrating power of a lubricant of some embodiments makes it useful as a release agent and light duty lubricant. A lubricant of the present teachings can be used in, e.g., a home, a garage or a workshop.

A lubricant of the present teachings can be provided a non-flammable aerosol that can be ozone friendly.

In an embodiment, a lubricant aerosol can have a 360° valve below the nozzle. In some configurations, the aerosol to be completely inverted and still provide a spray for areas that can be otherwise inaccessible.

A lubricant of the present teachings can be silicone free.

In some configurations, a lubricant of the present teachings can have a gravity of 1.153 or about 1.153 compared to water and can get underneath existing moisture to lubricate and protect.

The present disclosure includes the following aspects:

1. A lubricant composition comprising, consisting essentially of or consisting of:
   a) about 15, 15-25, or about 25 wt % of a mineral oil;
   b) about 17, 17-27, or about 27 wt % of a petroleum hydrocarbon;
   c) about 5, 5-15, or about 15 wt % of a liquid wax;
   d) about 40, 40-60%, or about 50 wt % of a halogenated organic solvent;
   e) about 0.5, 0.5-1.5, or about 1.5 wt % of phosphoric acid esters;
   f) about 0.05, 0.05-0.15%, or about 0.15 wt % of a metal deactivator; and
   g) about 0.05, 0.05-1.5, or about 1.5 wt % of a cationic surfactant.

2. A lubricant composition comprising, consisting essentially of or consisting of:
   a) about 15, 15-25, or about 25 wt % of a mineral oil;
   b) about 17, 17-27, or about 27 wt % of a petroleum hydrocarbon;
   c) about 5, 5-15, or about 15 wt % of a liquid wax;
   d) about 40, 40-60%, or about 50 wt % of a halogenated organic solvent;
   e) about 0.5, 0.5-1.5, or about 1.5 wt % of phosphoric acid esters;
   f) about 0.05, 0.05-0.15%, or about 0.15 wt % of a metal deactivator; and
   g) about 0.05, 0.05-6.0, or about 6.0 wt % of a cationic surfactant.

3. A lubricant composition in accordance with aspect 2, further comprising, consisting essentially of or consisting of h) about 1, 1-10, or about 10 wt % of a nano diamond component that is a nano diamond powder or a 90 to 99% nano diamond concentrate.

4. A lubricant composition in accordance with any of aspects 1-3, wherein
   a) the mineral oil comprises, consists essentially of, or consists of a hydrotreated heavy naphthenic distillate;
   b) the petroleum hydrocarbon comprises, consists essentially of, or consists of a kerosene;
   c) the liquid wax comprises, consists essentially of, or consists of a mixture of at least one calcium alkylarylsulfonate, at least one calcium carboxylate and a plurality of petroleum oxidates;
   d) the halogenated organic solvent comprises, consists essentially of, or consists of parachlorobenzotrifluoride or perchloroethylene;
   e) the phosphoric acid esters comprise, consists essentially of, or consists of amine salts of aliphatic phosphoric acid esters;
   f) the metal deactivator comprises, consists essentially of, or consists of a benzotriazole metal deactivator; and
   g) the cationic surfactant comprises, consists essentially of, or consists of an N-tallow alkyl-1,3-diaminopropane dioleate surfactant.

5. A lubricant composition in accordance with aspects 3 or 4 comprising, consisting essentially of or consisting of h) about 1, 1-10, or about 10 wt. % of a nano diamond component comprising nano diamond particles having an average diameter of from about 4 to about 6 nm.

6. A lubricant composition in accordance with aspect 4 comprising, consisting essentially of or consisting of:
   a) about 20 wt % of a hydrotreated heavy naphthenic distillate;
   b) about 22.7 wt % of a kerosene;
   c) about 12 wt % of a liquid wax comprising a mixture of at least one calcium alkylarylsulfonate, at least one calcium carboxylate and a plurality of petroleum oxidates;
   d) about 43.95 wt % of parachlorobenzotrifluoride;
   e) about 1.0 wt % of amine salts of aliphatic phosphoric acid esters;
   f) about 0.1 wt % of a benzotriazole metal deactivator; and
   g) about 0.25 wt % of an N-tallow alkyl-1,3-diaminopropane dioleate surfactant.

7. A lubricant composition in accordance with aspects 3 or 4 comprising, consisting essentially of or consisting of:
   a) about 20 wt % of a hydrotreated heavy naphthenic distillate;
   b) about 22.7 wt % of a kerosene;
   c) about 10 wt % of a liquid wax comprising a mixture of at least one calcium alkylarylsulfonate, at least one calcium carboxylate and a plurality of petroleum oxidates;
   d) about 41.82 wt % of parachlorobenzotrifluoride;
   e) about 1.0 wt % of amine salts of aliphatic phosphoric acid esters;
   f) about 0.1 wt % of a benzotriazole metal deactivator; and
   g) about 1.0 wt % of an N-tallow alkyl-1,3-diaminopropane dioleate surfactant; and
   h) about 3.4 wt. % of a nano diamond component.

8. A lubricant composition in accordance with aspect 4 comprising, consisting essentially of or consisting of:
   a) about 21 wt % of a hydrotreated heavy naphthenic distillate;
   b) about 22.7 wt % of a kerosene;
   c) about 10.0 wt % of a liquid wax comprising a mixture of at least one calcium alkylarylsulfonate, at least one calcium carboxylate and a plurality of petroleum oxidates;
   d) about 40.2 wt % of parachlorobenzotrifluoride;
   e) about 1.0 wt % of amine salts of aliphatic phosphoric acid esters;
   f) about 0.1 wt % of a benzotriazole metal deactivator; and
   g) about 5.0 wt % of an N-tallow alkyl-1,3-diaminopropane dioleate surfactant.

9. A lubricant composition in accordance with aspect 4 comprising, consisting essentially of or consisting of:
   a) about 20 wt % of a hydrotreated heavy naphthenic distillate;
   b) about 22.7 wt % of a kerosene;

c) about 10 wt % of a liquid wax comprising a mixture of at least one calcium alkylarylsulfonate, at least one calcium carboxylate and a plurality of petroleum oxidates;
d) about 45.2 wt % of perchloroethylene;
e) about 1.0 wt % of amine salts of aliphatic phosphoric acid esters;
f) about 0.1 wt % of a benzotriazole metal deactivator; and
g) about 1.0 wt % of an N-tallow alkyl-1,3-diaminopropane dioleate surfactant.

10. A lubricant composition in accordance with aspect 4, comprising, consisting essentially of or consisting of:
a) about 20 wt % of a hydrotreated heavy naphthenic distillate;
b) about 22.7 wt % of a kerosene;
c) about 12 wt % of a liquid wax comprising a mixture of at least one calcium alkylarylsulfonate, at least one calcium carboxylate and a plurality of petroleum oxidates;
d) about 43.95 wt % of perchloroethylene;
e) about 1.0 wt % of amine salts of aliphatic phosphoric acid esters;
f) about 0.1 wt % of a benzotriazole metal deactivator; and
g) about 0.25 wt % of an N-tallow alkyl-1,3-diaminopropane dioleate surfactant.

11. A lubricant composition in accordance with aspect 4, comprising, consisting essentially of or consisting of:
a) about 20 wt % of a hydrotreated heavy naphthenic distillate;
b) about 22.7 wt % of a kerosene;
c) about 10 wt % of a liquid wax comprising a mixture of at least one calcium alkylarylsulfonate, at least one calcium carboxylate and a plurality of petroleum oxidates;
d) about 45.2 wt % of parachlorobenzotrifluoride;
e) about 1.0 wt % of amine salts of aliphatic phosphoric acid esters;
f) about 0.1 wt % of a benzotriazole metal deactivator; and
g) about 1.0 wt % of an N-tallow alkyl-1,3-diaminopropane dioleate surfactant.

12. A lubricant composition of aspect 2, comprising, consisting essentially of or consisting of:
a) about 20 wt % of a hydrotreated heavy naphthenic distillate;
b) about 22.7 wt % of a kerosene;
c) about 12 wt % of a liquid wax comprising a mixture of at least one calcium alkylarylsulfonate, at least one calcium carboxylate and a plurality of petroleum oxidates;
d) about 43.95 wt % of parachlorobenzotrifluoride;
e) about 1.0 wt % of amine salts of aliphatic phosphoric acid esters;
f) about 0.1 wt % of a benzotriazole metal deactivator; and
g) about 0.25 wt % of an N-tallow alkyl-1,3-diaminopropane dioleate surfactant.

13. A lubricant composition in accordance with aspect 1, wherein the halogenated organic solvent is selected from the group consisting of parachlorobenzotrifluoride and perchloroethylene.

14. A lubricant composition comprising, consisting essentially of or consisting of:
a mineral oil;
a petroleum hydrocarbon;
a liquid wax;
a halogenated organic solvent;
phosphoric acid esters;
a metal deactivator; and
a cationic surfactant, wherein the lubricant yields <0.6 mm scar in an ASTM D 148 wear scar test.

15. A lubricant composition in accordance with aspect 8, wherein the lubricant composition yields about 0.55 mm scar in an ASTM D 148 wear scar test.

16. A lubricant composition comprising, consisting essentially of or consisting of:
a mineral oil;
a petroleum hydrocarbon;
a liquid wax;
a halogenated organic solvent;
phosphoric acid esters;
a metal deactivator; and
a cationic surfactant, wherein the lubricant exhibits >96 hrs to failure in an ASTM B 117 Salt Spray Test.

17. A lubricant composition in accordance with aspect 10, wherein the lubricant composition exhibits about 120 hrs to failure, or greater than about 120 hrs to failure in an ASTM B117 Salt Spray Test.

18. A method of making a lubricant composition, comprising adding together in any order:
a) about 15 to about 25 wt % of a mineral oil;
b) about 17 to about 27 wt % of a petroleum hydrocarbon;
c) about 5 to about 15 wt % of a liquid wax;
d) about 40 to about 50 wt % of a halogenated organic solvent;
e) about 0.5 to about 1.5 wt % of phosphoric acid esters;
f) about 0.05 to about 0.15 wt % of a metal deactivator; and
g) about 0.05 to about 1.5 wt % of a cationic surfactant.

19. A method of making a lubricant composition, comprising adding together in any order:
a) about 15 to about 25 wt % of a mineral oil;
b) about 17 to about 27 wt % of a petroleum hydrocarbon;
c) about 5 to about 15 wt % of a liquid wax;
d) about 40 to about 50 wt % of a halogenated organic solvent;
e) about 0.5 to about 1.5 wt % of phosphoric acid esters;
f) about 0.05 to about 0.15 wt % of a metal deactivator; and
g) about 0.05 to about 6.0 wt % of a cationic surfactant.

20. A method in accordance with aspect 19, further comprising adding to a)-g) in any order, h) about 1 to about 10 wt % of a nano diamond component that is a nano diamond powder or a 90 to 99% nano diamond concentrate.

21. A method in accordance with any of aspects 18-20, wherein
a) the mineral oil comprises, consists essentially of, or consists of a hydrotreated heavy naphthenic distillate;
b) the petroleum hydrocarbon comprises, consists essentially of, or consists of a kerosene;
c) the liquid wax comprises, consists essentially of, or consists of a mixture of at least one calcium alkylarylsulfonate, at least one calcium carboxylate and a plurality of petroleum oxidates;
d) the halogenated organic solvent comprises, consists essentially of or consists of parachlorobenzotrifluoride or perchloroethylene;
e) the phosphoric acid esters comprise, consists essentially of, or consists of amine salts of aliphatic phosphoric acid esters;
f) the metal deactivator comprises, consists essentially of, or consists of a benzotriazole metal deactivator; and g) the cationic surfactant comprises, consists essentially of, or consists of an N-tallow alkyl-1,3-diaminopropane dioleate surfactant.

22. A method in accordance with aspects 20 or 21, further comprising adding h) about 1, 1-10, or about 10 wt. % of a nano diamond component comprising nano diamond particles having an average diameter of from about 4 to about 6 nm.

23. A method in accordance with aspect 21, comprising, consisting essentially of or consisting of adding together:

a) about 20 wt % of a hydrotreated heavy naphthenic distillate;
b) about 22.7 wt % of a kerosene;
c) about 12 wt % of a liquid wax comprising a mixture of at least one calcium alkylarylsulfonate, at least one calcium carboxylate and a plurality of petroleum oxidates;
d) about 43.95 wt % of parachlorobenzotrifluoride;
e) about 1.0 wt % of amine salts of aliphatic phosphoric acid esters;
f) about 0.1 wt % of a benzotriazole metal deactivator; and
g) about 0.25 wt % of an N-tallow alkyl-1,3-diaminopropane dioleate surfactant.

24. A method in accordance with aspects 20 or 21, comprising, consisting essentially of or consisting of adding together:

a) about 20 wt % of a hydrotreated heavy naphthenic distillate;
b) about 22.7 wt % of a kerosene;
c) about 10 wt % of a liquid wax comprising a mixture of at least one calcium alkylarylsulfonate, at least one calcium carboxylate and a plurality of petroleum oxidates;
d) about 41.82 wt % of parachlorobenzotrifluoride;
e) about 1.0 wt % of amine salts of aliphatic phosphoric acid esters;
f) about 0.1 wt % of a benzotriazole metal deactivator; and
g) about 1.0 wt % of an N-tallow alkyl-1,3-diaminopropane dioleate surfactant; and
h) about 3.4 wt. % of a nano diamond component.

25. A method in accordance with aspect 21 comprising, consisting essentially of or consisting of adding together:

a) about 21 wt % of a hydrotreated heavy naphthenic distillate;
b) about 22.7 wt % of a kerosene;
c) about 10.0 wt % of a liquid wax comprising a mixture of at least one calcium alkylarylsulfonate, at least one calcium carboxylate and a plurality of petroleum oxidates;
d) about 40.2 wt % of parachlorobenzotrifluoride;
e) about 1.0 wt % of amine salts of aliphatic phosphoric acid esters;
f) about 0.1 wt % of a benzotriazole metal deactivator; and
g) about 5.0 wt % of an N-tallow alkyl-1,3-diaminopropane dioleate surfactant.

26. A method in accordance with aspect 21, comprising, consisting essentially of or consisting of adding together:

a) about 20 wt % of a hydrotreated heavy naphthenic distillate;
b) about 22.7 wt % of a kerosene;
c) about 10 wt % of a liquid wax comprising a mixture of at least one calcium alkylarylsulfonate, at least one calcium carboxylate and a plurality of petroleum oxidates;
d) about 45.2 wt % of perchloroethylene;
e) about 1.0 wt % of amine salts of aliphatic phosphoric acid esters;
f) about 0.1 wt % of a benzotriazole metal deactivator; and
g) about 1.0 wt % of an N-tallow alkyl-1,3-diaminopropane dioleate surfactant.

27. A method in accordance with aspect 21, comprising, consisting essentially of or consisting of adding together:

a) about 20 wt % of a hydrotreated heavy naphthenic distillate;
b) about 22.7 wt % of a kerosene;
c) about 12 wt % of a liquid wax comprising a mixture of at least one calcium alkylarylsulfonate, at least one calcium carboxylate and a plurality of petroleum oxidates;
d) about 43.95 wt % of perchloroethylene;
e) about 1.0 wt % of amine salts of aliphatic phosphoric acid esters;
f) about 0.1 wt % of a benzotriazole metal deactivator; and
g) about 0.25 wt % of an N-tallow alkyl-1,3-diaminopropane dioleate surfactant.

28. A method in accordance with aspect 21, comprising, consisting essentially of or consisting of adding together:

a) about 20 wt % of a hydrotreated heavy naphthenic distillate;
b) about 22.7 wt % of a kerosene;
c) about 10 wt % of a liquid wax comprising a mixture of at least one calcium alkylarylsulfonate, at least one calcium carboxylate and a plurality of petroleum oxidates;
d) about 45.2 wt % of parachlorobenzotrifluoride;
e) about 1.0 wt % of amine salts of aliphatic phosphoric acid esters;
f) about 0.1 wt % of a benzotriazole metal deactivator; and
g) about 1.0 wt % of an N-tallow alkyl-1,3-diaminopropane dioleate surfactant.

29. A method in accordance with aspect 21, comprising, consisting essentially of or consisting of adding together:

a) about 20 wt % of a hydrotreated heavy naphthenic distillate;
b) about 22.7 wt % of a kerosene;
c) about 12 wt % of a liquid wax comprising a mixture of at least one calcium alkylarylsulfonate, at least one calcium carboxylate and a plurality of petroleum oxidates;
d) about 43.95 wt % of parachlorobenzotrifluoride;
e) about 1.0 wt % of amine salts of aliphatic phosphoric acid esters;
f) about 0.1 wt % of a benzotriazole metal deactivator; and
g) about 0.25 wt % of an N-tallow alkyl-1,3-diaminopropane dioleate surfactant.

30. A method of lubricating an apparatus comprising, consisting essentially of or consisting of:

1) providing a lubricating composition comprising, consisting essentially of or consisting of:
   a) about 15 to about 25 wt % of a mineral oil;
   b) about 17 to about 27 wt % of a petroleum hydrocarbon;
   c) about 5 to about 15 wt % of a liquid wax;
   d) about 40 to about 50 wt % of a halogenated organic solvent;
   e) about 0.5 to about 1.5 wt % of phosphoric acid esters;

f) about 0.05 to about 0.15 wt % of a metal deactivator; and g) about 0.05 to about 1.5 wt % of a cationic surfactant; and 2) applying the lubricating composition to lubricate the apparatus.

31. A method of lubricating an apparatus, comprising:

1) providing a lubricating composition comprising, consisting essentially of or consisting of:

a) about 15 to about 25 wt % of a mineral oil;

b) about 17 to about 27 wt % of a petroleum hydrocarbon;

c) about 5 to about 15 wt % of a liquid wax;

d) about 40 to about 50 wt % of a halogenated organic solvent;

e) about 0.5 to about 1.5 wt % of phosphoric acid esters;

f) about 0.05 to about 0.15 wt % of a metal deactivator; and g) about 0.05 to about 6.0 wt % of a cationic surfactant; and 2) applying the lubricating composition to lubricate the apparatus.

32. A method in accordance with aspect 31, wherein the lubricating composition further comprises, consists essentially of or consists of h) about 1 to about 10 wt % of a nano diamond component that is a nano diamond powder or a 90 to 99% nano diamond concentrate.

33. A method of lubricating an apparatus in accordance with any of aspects 30-32, wherein:

a) the mineral oil comprises, consists essentially of, or consists of a hydrotreated heavy naphthenic distillate;

b) the petroleum hydrocarbon comprises, consists essentially of, or consists of a kerosene;

c) the liquid wax comprises, consists essentially of, or consists of a mixture of at least one calcium alkylarylsulfonate, at least one calcium carboxylate and a plurality of petroleum oxidates;

d) the halogenated organic solvent comprises, consists essentially of, or consists of parachlorobenzotrifluoride or perchloroethylene;

e) the phosphoric acid esters comprise, consists essentially of, or consists of amine salts of an aliphatic phosphoric acid esters;

f) the metal deactivator comprises, consists essentially of, or consists of a benzotriazole metal deactivator; and g) the cationic surfactant comprises, consists essentially of, or consists of an N-tallow alkyl-1,3-diaminopropane dioleate surfactant.

34. A method in accordance with aspect 33, wherein the lubricant composition further comprises, consists essentially of or consists of h) about 1 to about 10 wt. % of a nano diamond component comprising nano diamond particles having an average diameter of from about 4 to about 6 nm.

35. A method of lubricating a device in accordance with aspect 33, wherein the composition comprises, consists essentially of or consists of:

a) about 20 wt % of a hydrotreated heavy naphthenic distillate;

b) about 22.7 wt % of a kerosene;

c) about 12 wt % of a liquid wax comprising a mixture of at least one calcium alkylarylsulfonate, at least one calcium carboxylate and a plurality of petroleum oxidates;

d) about 43.95 wt % of parachlorobenzotrifluoride;

e) about 1.0 wt % of amine salts of aliphatic phosphoric acid esters;

f) about 0.1 wt % of a benzotriazole metal deactivator; and g) about 0.25 wt % of an N-tallow alkyl-1,3-diaminopropane dioleate surfactant.

36. A method of lubricating a device in accordance with aspects 32 or 33, wherein the composition comprises, consists essentially of or consists of:

a) about 20 wt % of a hydrotreated heavy naphthenic distillate;

b) about 22.7 wt % of a kerosene;

c) about 10 wt % of a liquid wax comprising a mixture of at least one calcium alkylarylsulfonate, at least one calcium carboxylate and a plurality of petroleum oxidates;

d) about 41.82 wt % of parachlorobenzotrifluoride;

e) about 1.0 wt % of amine salts of aliphatic phosphoric acid esters;

f) about 0.1 wt % of a benzotriazole metal deactivator; and g) about 1.0 wt % of an N-tallow alkyl-1,3-diaminopropane dioleate surfactant; and h) about 3.4 wt. % of a nano diamond component.

37. A method of lubricating a device in accordance with aspect 33, wherein the composition comprises, consists essentially of or consists of:

a) about 21 wt % of a hydrotreated heavy naphthenic distillate;

b) about 22.7 wt % of a kerosene;

c) about 10.0 wt % of a liquid wax comprising a mixture of at least one calcium alkylarylsulfonate, at least one calcium carboxylate and a plurality of petroleum oxidates;

d) about 40.2 wt % of parachlorobenzotrifluoride;

e) about 1.0 wt % of amine salts of aliphatic phosphoric acid esters;

f) about 0.1 wt % of a benzotriazole metal deactivator; and g) about 5.0 wt % of an N-tallow alkyl-1,3-diaminopropane dioleate surfactant.

38. A method of lubricating a device in accordance with aspect 33, wherein the composition comprises, consists essentially of or consists of:

a) about 20 wt % of a hydrotreated heavy naphthenic distillate;

b) about 22.7 wt % of a kerosene;

c) about 10 wt % of a liquid wax comprising a mixture of at least one calcium alkylarylsulfonate, at least one calcium carboxylate and a plurality of petroleum oxidates;

d) about 45.2 wt % of perchloroethylene;

e) about 1.0 wt % of amine salts of aliphatic phosphoric acid esters;

f) about 0.1 wt % of a benzotriazole metal deactivator; and g) about 1.0 wt % of an N-tallow alkyl-1,3-diaminopropane dioleate surfactant.

39. A method of lubricating a device in accordance with aspect 33, wherein the composition comprises, consists essentially of or consists of:

a) about 20 wt % of a hydrotreated heavy naphthenic distillate;
b) about 22.7 wt % of a kerosene;
c) about 12 wt % of a liquid wax comprising a mixture of at least one calcium alkylarylsulfonate, at least one calcium carboxylate and a plurality of petroleum oxidates;
d) about 43.95 wt % of perchloroethylene;
e) about 1.0 wt % of amine salts of aliphatic phosphoric acid esters;
f) about 0.1 wt % of a benzotriazole metal deactivator; and
g) about 0.25 wt % of an N-tallow alkyl-1,3-diaminopropane dioleate surfactant.

40. A method of lubricating a device in accordance with aspect 33, wherein the composition comprises, consists essentially of or consists of:
a) about 20 wt % of a hydrotreated heavy naphthenic distillate;
b) about 22.7 wt % of a kerosene;
c) about 10 wt % of a liquid wax comprising a mixture of at least one calcium alkylarylsulfonate, at least one calcium carboxylate and a plurality of petroleum oxidates;
d) about 45.2 wt % of parachlorobenzotrifluoride;
e) about 1.0 wt % of amine salts of aliphatic phosphoric acid esters;
f) about 0.1 wt % of a benzotriazole metal deactivator; and
g) about 1.0 wt % of an N-tallow alkyl-1,3-diaminopropane dioleate surfactant.

41. A method of lubricating a device in accordance with aspect 33, wherein the composition comprises, consists essentially of or consists of:
a) about 20 wt % of a hydrotreated heavy naphthenic distillate;
b) about 22.7 wt % of a kerosene;
c) about 12 wt % of a liquid wax comprising a mixture of at least one calcium alkylarylsulfonate, at least one calcium carboxylate and a plurality of petroleum oxidates;
d) about 43.95 wt % of parachlorobenzotrifluoride;
e) about 1.0 wt % of amine salts of aliphatic phosphoric acid esters;
f) about 0.1 wt % of a benzotriazole metal deactivator; and
g) about 0.25 wt % of an N-tallow alkyl-1,3-diaminopropane dioleate surfactant.

42. An apparatus containing a lubricant composition for aerosol delivery, said apparatus comprising:
a container;
a lubricant composition of any one of aspects 1-17 contained therein;
a propellant, and
an actuating valve for discharging the composition in the container in an aerosol form.

43. An apparatus in accordance with aspect 42, wherein the propellant is carbon dioxide.

As used herein, the phrases "consisting essentially of" or "consists essentially of" in an aspect or claim relates to recited components or steps, and those that do not materially affect the basic and novel characteristic(s) of the aspect or claim. In non limiting example, an aspect or claim reciting a composition consisting essentially of components of a lubricant formulation but which omits a propellant or dispersant nonetheless includes the composition plus a propellant or dispersant.

DETAILED DESCRIPTION

Figure 1:
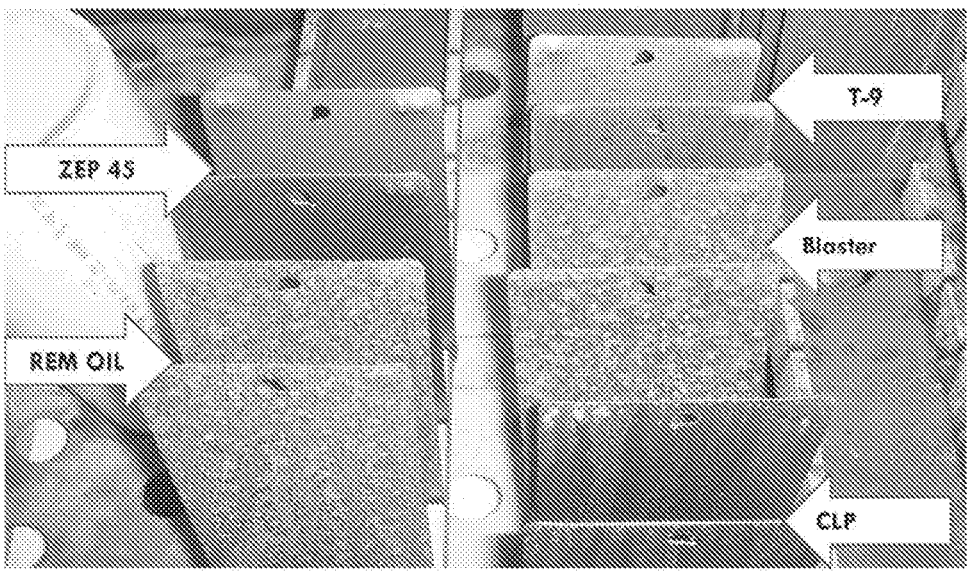
FIG. 1 illustrates commercial rust inhibitors and lube penetrants in 24 hour salt fog comparison.
Figure 2:
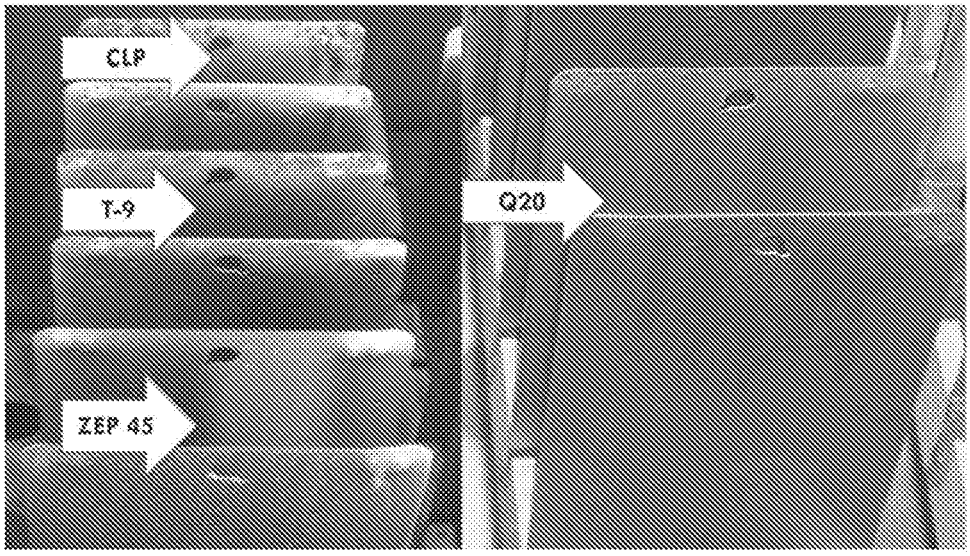
FIG. 2 illustrates salt fog test at 24 hours for commercial rust inhibitors (left) and Q20 formulation of the present teachings (right).
Figure 3:
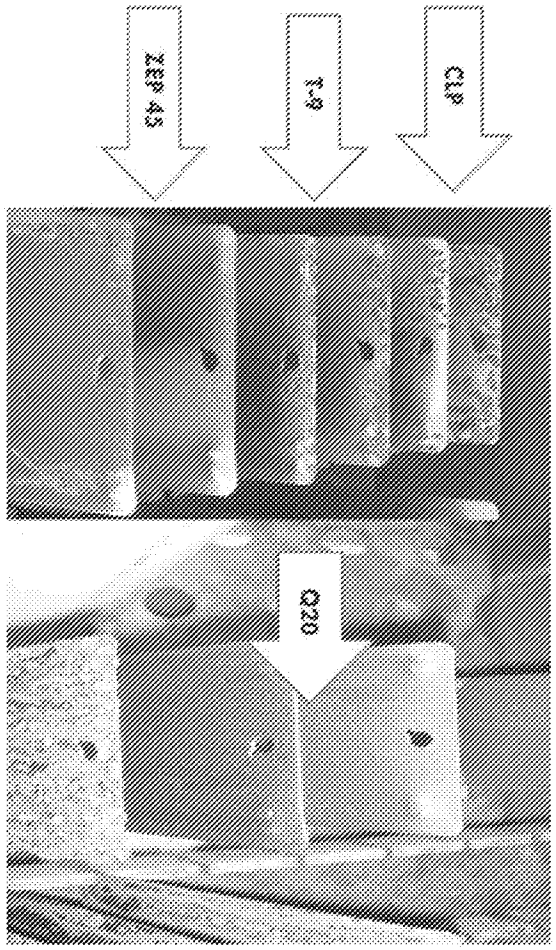
FIG. 3 illustrates salt fog test at 72 hours for commercial rust inhibitors (left) and Q20 formulation of the present teachings (right).
Figure 4:
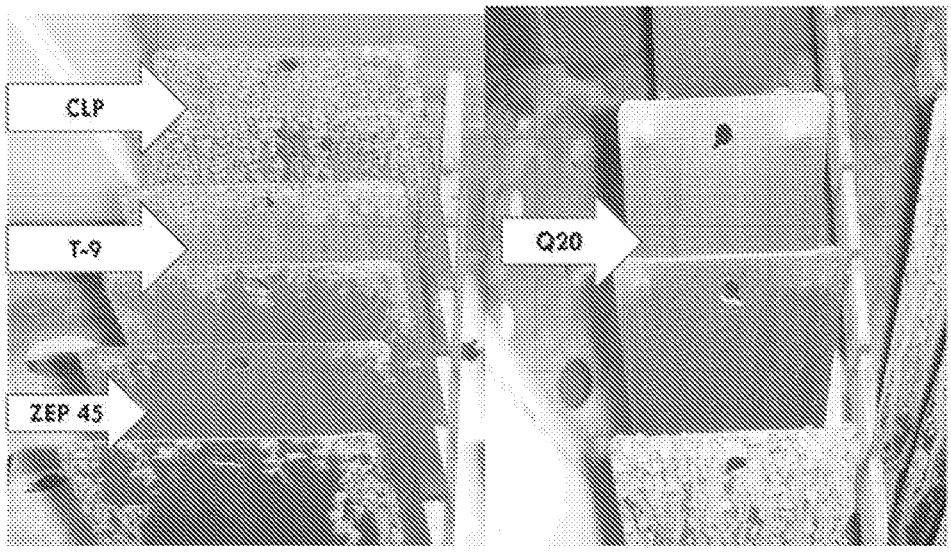
FIG. 4 illustrates salt fog test at 96 hours for commercial rust inhibitors (left) and Q20 formulation of the present teachings (right).
Figure 5:
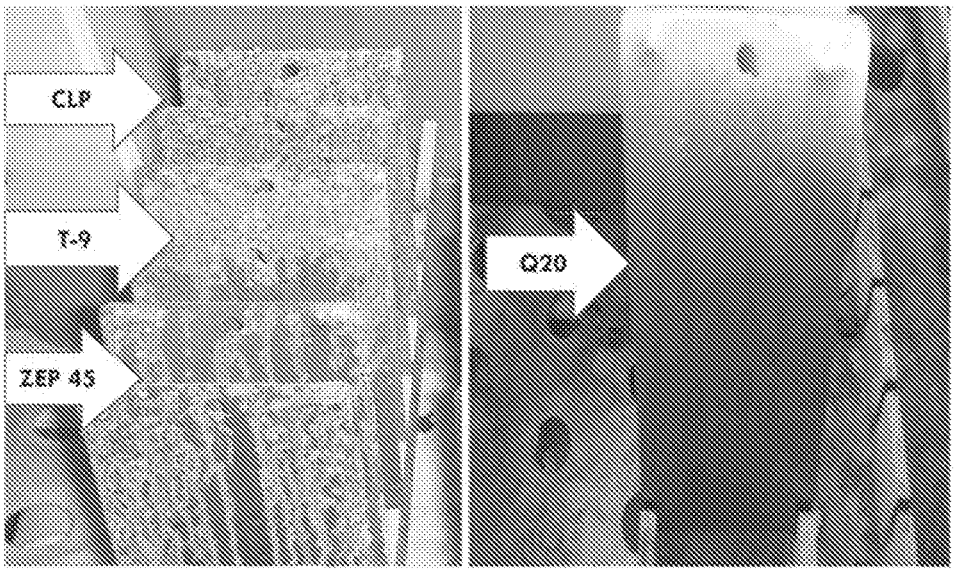
FIG. 5 illustrates salt fog test after 120 hours for commercial rust inhibitors (left), and salt fog test after 144 hours for Q20, a formulation of the present teachings (right).

The present teachings include corrosion-inhibiting lubricant compositions and methods therefor. The lubricants include petroleum-based components, corrosion-inhibiting components and a cationic surfactant.

Lubricant Components:

In general, a lubricant composition of the present teachings includes the following components: a) about 15 to about 25 wt % of a mineral oil; b) about 17 to about 27 wt % of a petroleum hydrocarbon; c) about 5 to about 15 wt % of a liquid wax; d) about 40 to about 50 wt % of a halogenated organic solvent; e) about 0.5 to about 1.5 wt % of phosphoric acid esters; f) about 0.05 to about 0.15 wt % of a metal deactivator; and g) about 0.05 to about 1.5 wt % of a cationic surfactant, or g) about 0.05 to about 6.0 wt % of a cationic surfactant. In various configurations, a lubricant composition may further include h) about 1 to about 10 wt % of a nano diamond component. Unless otherwise stated, wt % as referenced herein, is based upon the total weight of the composition.

Mineral Oil. One component of a composition of the present teachings is mineral oil. A mineral oil of the present teachings can be a petroleum-based composition that includes a naphthenic oil. In some configurations, the mineral oil can be characterized as a severely hydrotreated heavy naphthenic distillate having the CAS No. 64742-52-5. One such naphthenic distillate that can be used as a component of the lubricants of the present teachings is NAP 100 (NP22) which can be obtained from Americhem Sales Corporation (Mason, Mich.). The mineral oil can be present in the composition in an amount of from 15, about 15, 16, about 16, 17, about 17, 18, about 18, 19, about 19, 20, or about 20 weight % (wt %) up to 21, about 21, 22, about 22, 23, about 23, 24, about 24, 25, or about 25 wt %, based upon the total weight of the composition. In particular, the mineral oil can be present in an amount of about 15, about 16, about 17, about 18, about 19, about 20, about 21, about 22, about 23, about 24 or about 25 wt %. In some embodiments the mineral oil can be present in an amount of about 20 wt %.

Petroleum Hydrocarbon. The petroleum hydrocarbon can also be a petroleum-based component of the lubricant and, in particular, this component can be a kerosene. The kerosene can be a complex mixture of paraffins, cycloparaffins, olefins and aromatic hydrocarbons having hydrocarbon chain lengths predominantly in the range of C9 through C16 and containing trace amounts of benzene (<0.01%) and sulfur (15-499 ppm). In various configurations, the kerosene can be characterized as having CAS No. 8008-20-6. In various configurations, the kerosene may contain naphthalene (CAS No. 91-20-3) in an amount of from about 0.01 to about 0.5 wt. % or about 0.25 wt. %. One such kerosene that can be used as a component of a lubricant of the present teachings is k−1 kerosene which can be obtained from Marathon Petroleum Company, LLC (Findlay, Ohio). The petroleum hydrocarbon can be present in the composition in an amount of from 17, about 17, 18, about 18, 19, about 19, 20, about 20, 21, about 21, 22, about 22, 23, or about 23 wt % up to 24, about 24, 25, about 25, 26, about 26, 27, about 27, 28, or about 28 wt %, based upon the total weight of the composition. In particular, the petroleum hydrocarbon can be present in the composition in an amount of about 17, about 18, about 19, about 20, about 21, about 22, about 23, about 24, about 25, about 26 or about 27 wt %. In some embodiments, the petroleum hydrocarbon can be present in an amount of 22.7 or about 22.7 wt %.

Liquid Wax. Lubricant compositions of the present teachings also contain a liquid wax component that can also contain a rust preventative additive. The liquid wax component can be a mixture of at least one calcium alkylarylsulfonate such as for example calcium dinonylnaphthalene sulfonate, at least one calcium carboxylate or carboxylic acid and petroleum oxidates such as for example oxidized petrolatum. One such liquid wax component that can be used as a component of the lubricants of the present teachings is available under the name NA-SUL® CA/W 1146 from King Industries (Norwalk, Conn.). The liquid wax component can be present in the composition in an amount of from 5, about 5, 6, about 6, 7, about 7, 8, about 8, 9, about 9, 10 or about 10 wt % up to 11, about 11, 12, about 12, 13, about 13, 14, about 14, 15 or about 15 wt %, based upon the total weight of the composition. In particular, the liquid wax component can be present in the composition in an amount of about 5, about 6, about 7, about 8, about 9, about 10, about 11, about 12, about 13, about 14 or about 15 wt %. In some embodiments, the liquid wax component can be present in an amount of about 10 wt %, 11 wt % or about 12 wt %.

Halogenated Organic Solvent. The halogenated organic solvent component of a lubricant composition of the present teachings can be any of a number of halogenated organic solvents. Such halogenated organic solvents can include by way of non-limiting examples, benzotrichloride, bromoform, bromomethane, carbon tetrachloride, chlorobenzene, chlorofluorocarbon, chloroform, chloromethane, 1,1-dichloro-1-fluoroethane, 1,1-dichloroethane, 1,2-dichloroethane, 1,1-dichloroethene, 1,2-dichloroethene, dichloromethane, diiodomethane, FC-70. FC-75, haloalkane, halomethane, hexachlorobutadiene, hexafluoro-2-propanol, parachlorobenzotrifluoride, perfluorodecalin, perfluorohexane, perfluorooctane, tetrabromomethane, 1,1,1,2-tetrachloroethane, 1,1,2,2-tetrachloroethane, tetrachloroethylene, 1,3,5-trichlorobenzene, 1,1,1-trichloroethane, 1,1,2-trichloroethane, trichloroethylene, 1,2,3-trichloropropane, 2,2,2-trifluoroethanol or trihalomethane. In particular, the halogenated organic solvent of the lubricant composition can be perchloroethylene (CAS NO: 127-18-4) which can be obtained from Univar USA, Inc. (Rednond Wash. 9 8052) or parachlorobenzotrifluoride (CAS NO: 98-56-6) which can be obtained under the name OXSOL® 100 from MANA (New York, N.Y.). The halogenated organic solvent component can be present in the composition in an amount of from 40, about 40, 41, about 41, 42, about 42, 43, about 43, 44, about 44, 45 or about 45 wt % up to 46, about 46, 47, about 47, 48, about 48, 49, about 49, 50 or about 50 wt %, based upon the total weight of the composition. In particular, the halogenated organic solvent component can be present in the composition in an amount of about 40, about 41, about 42, about 43, about 44, about 45, about 46, about 47, about 48, about 49, or about 50 wt. %. In some embodiments, the halogenated organic solvent component can be present in an amount of 43.95 wt %, about 43.95 wt %, 45.2 wt % or about 45.2 wt %.

Phosphoric Acid Esters. The phosphoric acid esters component of a lubricant composition of the present teachings can be a mixture of amine salts of aliphatic phosphoric acid esters. In particular, one such mixture of amine salts of aliphatic phosphoric acid esters is available under the name NA-LUBE® AW-6110 from King Industries (Norwalk, Conn. 06852). The phosphoric acid esters component can be present in the composition in an amount of from 0.5, about 0.5, 0.6, about 0.6, 0.7, about 0.7, 0.8, about 0.8, 0.9, about 0.9, 1.0 or about 1.0 wt % up to 1.1, about 1.1, 1.2, about 1.2, 1.3, about 1.3, 1.4, about 1.4, 1.5 or about 1.5 wt %, based upon the total weight of the composition. In particular, the phosphoric acid ester component can be present in the composition in an amount of about 0.5, about 0.6, about 0.7, about 0.8, about 0.9, about 1.0, about 1.1, about 1.2, about 1.3, about 1.4, or about 1.5 wt. %. In some embodiments, the phosphoric acid ester component can be present in an amount of 1.0 wt % or about 1.0 wt %.

Metal Deactivator. The metal deactivators are corrosion inhibitors which act by deactivating metal parts with which they come in contact. Non-limiting examples of metal deactivators include benzotriazole derivatives; thiadiazole compounds such as, for example, 2,5-dimercapto 1,3,4-thiadiazole; mercaptobenzothiazole compounds which can be in the form of amine salts; sulphonamides; thiosulphonamides; dialkylphosphites; trialkyl phosphates; triarylphosphites; and thiophosphonates such as triphenyl or trilauryl thiophosphonate or trilauryl tetrathiophosphonate. Thus, the metal deactivator component of the lubricant composition can be a triazole metal deactivator and, in particular, a benzotriazol derivative metal deactivator. One such metal deactivator useful in a lubricant composition of the present teachings is the benzotriazole derivative yellow metal activator, which is available under the name K-Corr® NF 200 from King Industries (Norwalk, Conn.). The metal deactivator component can be present in the composition in an amount of from 0.05, about 0.05, 0.06, about 0.06, 0.07, about 0.07, 0.08, about 0.08, 0.09, about 0.09, 0.1 or about 0.1 wt % up to 0.11, about 0.11, 0.12, about 0.12, 0.13, about 0.13, 0.14, about 0.14, 0.15, or about 0.15 wt %, based upon the total weight of the composition. In particular, the metal deactivator component can be present in the composition in an amount of 0.05, about 0.05, 0.06, about 0.06, 0.07, about 0.07, 0.08, about 0.08, 0.09, about 0.09, 0.10, about 0.10, 0.11, about 0.11, 0.12, about 0.12, 0.13, about 0.13, 0.14, about 0.14, 0.15 or about 0.15 wt. %. In some embodiments, the metal deactivator component can be present in an amount of 0.10 wt % or about 0.10 wt %.

Cationic surfactant. The cationic surfactant component of a lubricant composition of the present teachings can be a long chain fatty amine derivative dispersant. Such cationic surfactants can be based upon alkyl groups ranging from about C8 to about C22, with C12 to C18 chain lengths being the most prominent. Such cationic surfactants include alkyldiamine dicarboxylates of the general formula $RNH(CH_2)_nNH_2.2R'COOH$ where R is an alkyl of about 8 carbon atoms, an alkyl of from 8 to 22 carbon atoms, or an alkyl of about 22 carbon atoms; R' is an alkyl or alkenyl of about 7 carbon atoms, an alkyl or alkenyl from 7 to 22 carbon atoms, or an alkyl or alkenyl of about 22 carbon atoms; and n is an integer from 1 up to 6, or about 6. In some configurations, a cationic surfactant can be one available under the trademark DUOMEEN® such as, for example, an N-tallow-1,3-diaminopropane dioleate which is available under the name DUOMEEN® TDO from Akzo Nobel Chemicals Inc. (Pasadena, Tex.). DUOMEEN® TDO is reported to include the following components:

| Name | CAS# | % by Weight |
|---|---|---|
| amines, n-tallow alkyltrimethylenedi-, oleates | 61791-53-5 | 98-100 |
| amines, n-tallow alkyltrimethylenedi- | 61791-55-7 | 0.001-2 |
| oleic acid | 112-80-1 | 0.001-2 |

In various configurations, the cationic surfactant component can be present in the composition in an amount of from 0.05, about 0.05, 0.1, about 0.1, 0.2, about 0.2, 0.3, about 0.3, 0.4, about 0.4, 0.5, about 0.5, 0.6, about 0.6, 0.7, about 0.7, 0.8, about 0.8, 0.9, about 0.9, 1.0, or about 1.0 wt % up to 1.1, about 1.1, 1.2, about 1.2, 1.3, about 1.3, 1.4, about 1.4, 1.5 or about 1.5, 1.6, about 1.6, 1.7, about 1.7, 1.8, about 1.8, 1.9, about 1.9, 2.0 or about 2.0, 2.1, about 2.1, 2.2, about 2.2, 2.3, about 2.3, 2.4, about 2.4, 2.5 or about 2.5, 2.6, about 2.6, 2.7, about 2.7, 2.8, about 2.8, 2.9, about 2.9, 3.0 or about 3.0, 3.1, about 3.1, 3.2, about 3.2, 3.3, about 3.3, 3.4, about 3.4, 3.5 or about 3.5, 3.6, about 3.6, 3.7, about 3.7, 3.8, about 3.8, 3.9, about 3.9, 4.0 or about 4.0, 4.1, about 4.1, 4.2, about 4.2, 4.3, about 4.3, 4.4, about 4.4, 4.5 or about 4.5, 4.6, about 4.6, 4.7, about 4.7, 4.8, about 4.8, 4.9, about 4.9, 5.0 or about 5.0, 5.1, about 5.1, 5.2, about 5.2, 5.3, about 5.3, 5.4, about 5.4, 5.5 or about 5.5, 5.6, about 5.6, 5.7, about 5.7, 5.8, about 5.8, 5.9, about 5.9, 6.0 or about 6.0 wt %, based upon the total weight of the composition. In particular, the cationic surfactant component can be present in the composition in an amount of 0.05, about 0.05, 0.1, about 0.1, 0.2, about 0.2, 0.3, about 0.3, 0.4, about 0.4, 0.5, about 0.5, 0.6, about 0.6, 0.7, about 0.7, 0.8, about 0.8, 0.9, about 0.9, 1.0, about 1.0, 1.1, about 1.1, 1.2, about 1.2, 1.3, about 1.3, 1.4, about 1.4, 1.5, or about 1.5, 1.6, about 1.6, 1.7, about 1.7, 1.8, about 1.8, 1.9, about 1.9, 2.0 or about 2.0, 2.1, about 2.1, 2.2, about 2.2, 2.3, about 2.3, 2.4, about 2.4, 2.5 or about 2.5, 2.6, about 2.6, 2.7, about 2.7, 2.8, about 2.8, 2.9, about 2.9, 3.0 or about 3.0, 3.1, about 3.1, 3.2, about 3.2, 3.3, about 3.3, 3.4, about 3.4, 3.5 or about 3.5, 3.6, about 3.6, 3.7, about 3.7, 3.8, about 3.8, 3.9, about 3.9, 4.0 or about 4.0, 4.1, about 4.1, 4.2, about 4.2, 4.3, about 4.3, 4.4, about 4.4, 4.5 or about 4.5, 4.6, about 4.6, 4.7, about 4.7, 4.8, about 4.8, 4.9, about 4.9, 5.0 or about 5.0, 5.1, about 5.1, 5.2, about 5.2, 5.3, about 5.3, 5.4, about 5.4, 5.5 or about 5.5, 5.6, about 5.6, 5.7, about 5.7, 5.8, about 5.8, 5.9, about 5.9, 6.0 or about 6.0 wt. %. In some embodiments, the cationic surfactant component can be present in an amount of about 0.25 wt % or about 1.0 wt % or about 5.0 wt %.

Nano diamond component. The nano diamonds can be produced, for example, by an explosive process at a molecular level such as that described in U.S. Pat. Nos. 5,916,955 and 5,861,349. The method may involve detonation of a carbon-containing explosive substance or a mixture of explosive substances under conditions of negative oxygen balance in a closed volume and in an atmosphere of gases that is substantially inert to carbon. The nano diamonds may then be purified to remove foreign substances such as graphite formed in the reaction. The vast majority of nano diamonds produced by such methods can have a diameter of less than 10 nm. The average diameter of the nano diamonds of the present invention may be from about 0.1 to about 10 nm, from about 1 to about 10 nm, from about 3 to about 7 nm or from about 4 to about 6 nm. More particularly, the average diameter may be from 0.1 or about 0.1, 0.2 or about 0.2, 0.3 or about 0.3, 0.4 or about 0.4, 0.5 or about 0.5, 0.6 or about 0.6, 0.7 or about 0.7, 0.8 or about 0.8, 0.9 or about 0.9, 1.0 or about 1.0, 1.1 or about 1.1, 1.2 or about 1.2, 1.3 or about 1.3, 1.4 or about 1.4, 1.5 or about 1.5, 1.6 or about 1.6, 1.7 or about 1.7, 1.8 or about 1.8, 1.9 or about 1.9, 2.0 or about 2.0, 2.1 or about 2.1, 2.2 or about 2.2, 2.3 or about 2.3, 2.4 or about 2.4, 2.5 or about 2.5, 2.6 or about 2.6, 2.7 or about 2.7, 2.8 or about 2.8, 2.9 or about 2.9, 3.0 or about 3.0, 3.1 or about 3.1, 3.2 or about 3.2, 3.3 or about 3.3, 3.4 or about 3.4, 3.5 or about 3.5, 3.6 or about 3.6, 3.7 or about 3.7, 3.8 or about 3.8, 3.9 or about 3.9, 4.0 or about 4.0 nm up to 6.0 or about 6.0, 6.1 or about 6.1, 6.2 or about 6.2, 6.3 or about 6.3, 6.4 or about 6.4, 6.5 or about 6.5, 6.6 or about 6.6, 6.7 or about 6.7, 6.8 or about 6.8, 6.9 or about 6.9, 7.0 or about 7.0, 7.1 or about 7.1, 7.2 or about 7.2, 7.3 or about 7.3, 7.4 or about 7.4, 7.5 or about 7.5, 7.6 or about 7.6, 7.7 or about 7.7, 7.8 or about 7.8, 7.9 or about 7.9, 8.0 or about 8.0, 8.1 or about 8.1, 8.2 or about 8.2, 8.3 or about 8.3, 8.4 or about 8.4, 8.5 or about 8.5, 8.6 or about 8.6, 8.7 or about 8.7, 8.8 or about 8.8, 8.9 or about 8.9, 9.0 or about 9.0, 9.1 or about 9.1, 9.2 or about 9.2, 9.3 or about 9.3, 9.4 or about 9.4, 9.5 or about 9.5, 9.6 or about 9.6, 9.7 or about 9.7, 9.8 or about 9.8, 9.9 or about 9.9, 10.0 or about 10.0 nm. In some embodiments the average diameter of the nano diamonds may be from about 4 to about 6 nm. In some configurations, the nano diamond component can be one available from Nanotech Lubricants LLC, Wheeling, Ill. (see, for example U.S. Patent Application Publication 20100029518).

In various configurations, the nano diamond component may be in a powder form in which the nano diamonds have been purified to remove foreign substances such as graphite from the nano diamond particles. The purity may be, for example 98-99 wt % and the appearance is that of a gray nanopowder.

In other configurations, the nano diamond component of a lubricant composition of the present teachings may be a concentrate of nano diamonds in a composition that includes a dispersant such as a nonionic surfactant. Some non-limiting examples of dispersants include polyoxyethylene alkyl ethers, polyoxyethylene dialkylphenol ethers, alkylglycoside, polyoxyethylene fatty acid esters, sucrose fatty acid esters, sorbitan fatty acid esters, polyoxyethylene sorbitan fatty acid esters, fatty acid alkanolamide. The nano diamond composition may contain from about 90 to about 95 wt. % nano diamonds wt %, based upon the weight of the nano diamonds and the total weight of the nano diamond composition. In particular, the nano diamond composition may contain 50 or about 50, 51 or about 51, 52 or about 52, 53 or about 53, 54 or about 54, 55 or about 55, 56 or about 56, 57 or about 57, 58 or about 58, 59 or about 59, 609 or about 60, 61 or about 61, 62 or about 62, 63 or about 63, 64 or about 64, 65 or about 65, 66 or about 66, 67 or about 67, 68 or about 68, 69 or about 69, 70 or about 70, 71 or about 71, 72 or about 72, 73 or about 73, 74 or about 74, 75 or about 75, 76 or about 76, 77 or about 77, 78 or about 78, 79 or about 79, 80 or about 80, 81 or about 81, 82 or about 82, 83 or about 83, 84 or about 84, 85 or about 85, 86 or about 86, 87 or about 87, 88 or about 88, 89 or about 89, 90 or about 90, 91 or about 91, 92 or about 92, 93 or about 93, 94 or about 94, 95 or about 95, 96 or about 96, 97 or about 97, 98 or about 98, 99 or about 99 wt %, based upon the weight of the nano diamonds and the total weight of the nano diamond composition.

The nano diamond component can be present in the composition of the present teachings in an amount of from 0.05, about 0.05, 0.1, about 0.1, 0.2, about 0.2, 0.3, about 0.3, 0.4, about 0.4, 0.5, about 0.5, 0.6, about 0.6, 0.7, about 0.7, 0.8, about 0.8, 0.9, about 0.9, 1.0, or about 1.0, 1.1, about 1.1, 1.2, about 1.2, 1.3, about 1.3, 1.4, about 1.4, 1.5 or about 1.5, 1.6, about 1.6, 1.7, about 1.7, 1.8, about 1.8, 1.9, about 1.9, 2.0 or about 2.0, 2.1, about 2.1, 2.2, about 2.2, 2.3, about 2.3, 2.4, about 2.4, 2.5 or about 2.5, 2.6, about 2.6, 2.7, about 2.7, 2.8, about 2.8, 2.9, about 2.9, 3.0 or about 3.0 wt % up to 3.1, about 3.1, 3.2, about 3.2, 3.3, about 3.3, 3.4, about 3.4, 3.5 or about 3.5, 3.6, about 3.6, 3.7, about 3.7, 3.8, about 3.8, 3.9, about 3.9, 4.0 or about 4.0, 4.1, about 4.1, 4.2, about 4.2, 4.3, about 4.3, 4.4, about 4.4, 4.5 or about 4.5, 4.6, about 4.6, 4.7, about 4.7, 4.8, about 4.8, 4.9, about 4.9, 5.0 or about 5.0, 5.1, about 5.1, 5.2, about 5.2, 5.3, about 5.3, 5.4, about 5.4, 5.5 or about 5.5, 5.6, about 5.6, 5.7, about 5.7, 5.8, about 5.8, 5.9, about 5.9, 6.0 or about 6.0, 6.1, about 6.1, 6.2, about 6.2, 6.3, about 6.3, 6.4, about 6.4, 6.5 or about 6.5, 6.6, about 6.6, 6.7, about 6.7, 6.8, about 6.8, 6.9, about 6.9, 7.0 or about 7.0, 7.1, about 7.1, 7.2, about 7.2, 7.3, about 7.3, 7.4, about 7.4, 7.5 or about 7.5, 7.6, about 7.6, 7.7, about 7.7, 7.8, about 7.8, 7.9, about 7.9, 8.0 or about 8.0, 8.1, about 8.1, 8.2, about 8.2, 8.3, about 8.3, 8.4, about 8.4, 8.5 or about 8.5, 8.6, about 8.6, 8.7, about 8.7, 8.8, about 8.8, 8.9, about 8.9, 9.0 or about 9.0 wt %, based upon the weight of the nano diamonds or the weight of the nano diamond composition and the total weight of the lubricant composition.

In particular, the nano diamond component can be present in the composition in an amount of 0.05, about 0.05, 0.1, about 0.1, 0.2, about 0.2, 0.3, about 0.3, 0.4, about 0.4, 0.5, about 0.5, 0.6, about 0.6, 0.7, about 0.7, 0.8, about 0.8, 0.9, about 0.9, 1.0, about 1.0, 1.1, about 1.1, 1.2, about 1.2, 1.3, about 1.3, 1.4, about 1.4, 1.5, or about 1.5, 1.6, about 1.6, 1.7, about 1.7, 1.8, about 1.8, 1.9, about 1.9, 2.0 or about 2.0, 2.1, about 2.1, 2.2, about 2.2, 2.3, about 2.3, 2.4, about 2.4, 2.5 or about 2.5, 2.6, about 2.6, 2.7, about 2.7, 2.8, about 2.8, 2.9, about 2.9, 3.0 or about 3.0, 3.1, about 3.1, 3.2, about 3.2, 3.3, about 3.3, 3.4, about 3.4, 3.5 or about 3.5, 3.6, about 3.6, 3.7, about 3.7, 3.8, about 3.8, 3.9, about 3.9, 4.0 or about 4.0, 4.1, about 4.1, 4.2, about 4.2, 4.3, about 4.3, 4.4, about 4.4, 4.5 or about 4.5, 4.6, about 4.6, 4.7, about 4.7, 4.8, about 4.8, 4.9, about 4.9, 5.0 or about 5.0, 5.1, about 5.1, 5.2, about 5.2, 5.3, about 5.3, 5.4, about 5.4, 5.5 or about 5.5, 5.6, about 5.6, 5.7, about 5.7, 5.8, about 5.8, 5.9, about 5.9, 6.0 or about 6.0, 6.1, about 6.1, 6.2, about 6.2, 6.3, about 6.3, 6.4, about 6.4, 6.5 or about 6.5, 6.6, about 6.6, 6.7, about 6.7, 6.8, about 6.8, 6.9, about 6.9, 7.0 or about 7.0, 7.1, about 7.1, 7.2, about 7.2, 7.3, about 7.3, 7.4, about 7.4, 7.5 or about 7.5, 7.6, about 7.6, 7.7, about 7.7, 7.8, about 7.8, 7.9, about 7.9, 8.0 or about 8.0, 8.1, about 8.1, 8.2, about 8.2, 8.3, about 8.3, 8.4, about 8.4, 8.5 or about 8.5, 8.6, about 8.6, 8.7, about 8.7, 8.8, about 8.8, 8.9, about 8.9, 9.0 or about 9.0 wt. %. In some embodiments, the nano diamond component can be present in an amount of about 0.25 wt % or about 1.0 wt % or about 3.0 wt % or about 5.0 wt % based upon the weight of the nano diamonds or the weight of the nano diamond composition and the total weight of the composition.

Lubricant Testing Procedures: Corrosion-inhibiting lubricants can be tested using various procedures well known in the art. In particular, the salt spray (fog) test is a standardized test used to evaluate corrosion resistance. The apparatus used for the salt spray test is a closed testing chamber in which a salt containing solution is atomized by means of a nozzle to create a corrosive environment of a dense saline fog in the chamber. Metal parts within the chamber are thus exposed to the fog and are attacked under this severe corroding atmosphere. Chamber volume is typically about 15 cubic feet up to about 160 cubic feet.

Tests are performed with a standardized salt solution, typically about 5% saline referenced as NSS (neutral salt spray) and results are represented as testing hours in NSS without appearance of corrosion. Standardized procedures are described under national and international standards such as, for example ASTM B117 (ASTM B117, American Society for Testing and Materials. "Salt Spray (Fog) Testing," Philadelphia, Pa.).

Applications: The corrosion-inhibiting lubricants of the present teachings displace moisture, inhibit rust formation and provide lubrication. The compositions are silicone-free and they are ideal for numerous applications including, but not limited to industrial applications such as use as anti-seize compounds, chain and cable lubricants, gear lubricants, drill steel lubricants, open gear lubricants, air compressor lubricants, turbine lubricants and the like; automotive and motorcycle uses such as engine oils, transmission fluids, automotive gear oils, hydraulic fluids and the like; farm and heavy equipment applications; marine applications such as in marine engines; household applications such as on hinges and sliding components of doors and windows, motors of household devices and lawn equipment and the like; electrical and power tool applications, firearm applications such as for cleaning and lubrication as well as sports and recreational applications.

In some applications, the corrosion-inhibiting lubricants of the present teachings can be incorporated into a system for delivery as an aerosol spray (see, for example, U.S. Pat. No. 7,578,372). Such systems include a container within which the lubricant resides, a tube or other transfer means through which the lubricant travels to reach an actuator valve that delivers the lubricant in an aerosol mist. The aerosol container can be a metal can or a glass or plastic bottle designed to contain and dispense the aerosol. The container can also contain a pressurized propellant that can serve to move the lubricant to the actuator valve and aerosolize the lubricant. The propellant can be a liquefied or compressed gas within the aerosol container that expels the lubricant in the container when the valve is actuated. Non-limiting examples of propellants include gaseous hydrocarbons such as isobutene, propane or mixtures thereof. The lubricant compositions of the present teachings produce a Level 1 aerosol, i.e. an aerosol with a total chemical heat of combustion that is greater than 8,600 Btu/lb (20 kg/g), but less than or equal to 13,000 Btu/lb (30 kg/g).

EXAMPLES

The following examples are illustrative of various embodiments of the present teachings. The examples are not intended to limit the scope of the claims.

Example 1

This example illustrates a formulation of a corrosion-inhibiting lubricant of the present teachings, and a method of its preparation.

TABLE 1

| Formulation 1 (Q20 multi-purpose Lube G): | |
|---|---|
| NAP 100 (NP22) | 20.00% |
| Kerosene* | 22.70% |
| DUOMEEN ® TDO | 1.00% |
| King Ind. CA/W 1146 | 10.00% |
| Perchloroethylene | 45.20% |
| King. Ind. 6110 | 1.00% |
| King Ind. K-Corr NF 200 | 0.10% |

*includes: Kerosene, Low Sulfur (99.75% CAS#8008-20-6) 2.64325%; and Naphthalene (CAS# 91-20-3, 0.25% in kerosene) 0.05675%

NAP 100, Kerosene and Duomeen were blended together to produce a uniform mixture. King Ind. CA/W 1146, King Ind. 6110 and King Ind. K-Corr NF 200 were then added followed by mixing until clear. Perchloroethylene was then added and the batch mixed until clear and uniform.

Example 2

This example illustrates a formulation of a corrosion-inhibiting lubricant of the present teachings, and a method of its preparation.

TABLE 2

| Formulation 2 (Q20 Multi-purpose Lube G+): | |
|---|---|
| NAP 100 (NP22) | 20.00% |
| Kerosene* | 22.70% |
| King Ind. K-Corr NF 200 | 0.10% |
| King Ind. CA/W 1146 | 12.00% |
| Perchloroethylene | 43.95% |
| King. Ind. 6110 | 1.00% |
| DUOMEEN ® TDO | 0.25% |

*includes: Kerosene, Low Sulfur (99.75% CAS#8008-20-6) 2.64325%; and Naphthalene (CAS# 91-20-3, 0.25% in kerosene) 0.05675%

NAP 100, Kerosene and Duomeen were blended together to produce a uniform mixture. King Ind. CA/W 1146, King Ind. 6110 and King Ind. K-Corr NF 200 were then added followed by mixing until clear. Perchloroethylene was then added and the batch mixed until clear and uniform.

Example 3

This example illustrates a formulation of a corrosion-inhibiting lubricant of the present teachings, and a method of its preparation.

TABLE 3

| Formulation 3 (Q20 Multi-purpose Lube H): | |
|---|---|
| NAP 100 (NP22) | 20.00% |
| Kerosene* | 22.70% |
| DUOMEEN ® TDO | 1.00% |
| King Ind. CA/W 1146 | 10.00% |
| Parachlorobenzotrifluoride | 45.20% |
| King. Ind. 6110 | 1.00% |
| King Ind. K-Corr NF 200 | 0.10% |

*includes Kerosene, Low Sulfur (99.75% CAS#8008-20-6) 2.64325%, and Naphthalene (CAS# 91-20-3, 0.25% in kerosene) 0.05675%

NAP 100, Kerosene and Duomeen were blended together to produce a uniform mixture. King Ind. CA/W 1146, King Ind. 6110 and King Ind. K-Corr NF 200 were then added followed by mixing until clear. Parachlorobenzotrifluoride was then added and the batch mixed until clear and uniform.

Example 4

This example illustrates a formulation of a corrosion-inhibiting lubricant of the present teachings, and a method of its preparation.

TABLE 4

| Formulation 4 (Q20 Multi-purpose Lube H+): | |
|---|---|
| NAP 100 (NP22) | 20.00% |
| Kerosene* | 22.70% |
| King Ind. K-Corr NF 200 | 0.10% |
| King Ind. CA/W 1146 | 12.00% |
| Parachlorobenzotrifluoride | 43.95% |
| King. Ind. 6110 | 1.00% |
| DUOMEEN ® TDO | 0.25% |

*includes Kerosene, Low Sulfur (99.75% CAS#8008-20-6) 2.64325%, and Naphthalene (CAS# 91-20-3, 0.25% in kerosene) 0.05675%

NAP 100, Kerosene and Duomeen were blended together to produce a uniform mixture. King Ind. CA/W 1146, King Ind. 6110 and King Ind. K-Corr NF 200 were then added followed by mixing until clear. Parachlorobenzotrifluoride was then added and the batch mixed until clear and uniform.

Example 5

This example illustrates a formulation of a corrosion-inhibiting lubricant of the present teachings, and a method of its preparation.

TABLE 5

| Formulation 5 (Q20 Salt Formulation): | |
|---|---|
| NAP 100 (NP22) | 20.00% |
| Kerosene* | 22.70% |
| DUOMEEN ® TDO | 0.25% |
| King Ind. CA/W 1146 | 12.00% |
| Parachlorobenzotrifluoride | 43.95% |
| King. Ind. 6110 | 1.00% |
| King Ind. K-Corr NF 200 | 0.10% |

*includes Kerosene, Low Sulfur (99.75% CAS#8008-20-6) 2.64325%, and Naphthalene (CAS# 91-20-3, 0.25% in kerosene) 0.05675%

NAP 100, Kerosene and Duomeen were blended together to produce a uniform mixture. King Ind. CA/W 1146, King Ind. 6110 and King Ind. K-Corr NF 200 were then added followed by mixing until clear. Parachlorobenzotrifluoride was then added and the batch mixed until clear and uniform.

Example 6

This example illustrates a formulation of a corrosion-inhibiting lubricant of the present teachings, and a method of its preparation.

TABLE 6

| Formulation 6 (Q20 Penetrating Formulation): | |
|---|---|
| NAP 100 (NP22) | 20.00% |
| Kerosene* | 22.70% |
| King Ind. K-Corr NF 200 | 0.10% |
| King Ind. CA/W 1146 | 10.00% |
| Perchloroethylene | 41.82% |
| King. Ind. 6110 | 1.00% |
| DUOMEEN ® TDO | 1.0% |
| Aerosol Nano Diamond Concentrate | 3.38% |

*includes Kerosene, Low Sulfur (99.75% CAS#8008-20-6) 2.64325%, and Naphthalene (CAS# 91-20-3, 0.25% in kerosene) 0.05675%

NAP 100, Kerosene and Duomeen were blended together to produce a uniform mixture. King Ind. CA/W 1146, King Ind. 6110 and King Ind. K-Corr NF 200 were then added followed by mixing until clear. Parachlorobenzotrifluoride was then added and the batch mixed until clear and uniform. The Nano Diamond Concentrate was then added.

Example 7

This example illustrates a formulation of a corrosion-inhibiting lubricant of the present teachings, and a method of its preparation.

TABLE 7

| Formulation 7 (Q20 Ice Formulation): | |
|---|---|
| NAP 100 (NP22) | 21.00% |
| Kerosene* | 22.70% |
| DUOMEEN ® TDO | 5.00% |
| King Ind. CA/W 1146 | 10.00% |
| Parachlorobenzotrifluoride | 40.20% |
| King. Ind. 6110 | 1.00% |
| King Ind. K-Corr NF 200 | 0.10% |

*includes Kerosene, Low Sulfur (99.75% CAS#8008-20-6) 2.64325%, and Naphthalene (CAS# 91-20-3, 0.25% in kerosene) 0.05675%
NAP 100, Kerosene and Duomeen were blended together to produce a uniform mixture. King Ind. CA/W 1146, King Ind. 6110 and King Ind. K-Corr NF 200 were then added followed by mixing until clear. Parachlorobenzotrifluoride was then added and the batch mixed until clear and uniform.

Example 8

This example illustrates various embodiments of disclosed lubricant formulations, including can size, aerosol product label weight, and $CO_2$ propellant fill weight as shown in Table 8 and Table 8 below.

TABLE 8

| INGREDIENTS | Penetrating | H20 and ICE | Superior G | Industrial G+ | H Cal Superior and Fresh | Cal Industrial H+ and BLU and Salt | Salt |
|---|---|---|---|---|---|---|---|
| NP-22 (100% SEVERELY HYDROTREATED NAPHTHENIC OIL, CAS# 64742-52-5) | 20% | 21% | 20% | 20% | 20% | 20% | 20% |
| Kerosene, Low Sulfur (99.75% CAS# 8008-20-6 | 22.64325 | 22.64325 | 22.64325 | 22.64325 | 22.64325 | 22.64325 | 22.64325 |
| Napthalene (CAS# 91-20-3, 0.25% in kerosene above) | 0.05675 | 0.05675 | 0.05675 | 0.05675 | 0.05675 | 0.05675 | 0.05675 |
| DUOMEEN ® TDO (composition below): | 1% | 5% | 1% | 0.25% | 1.00% | 0.25% | 0.25% |
| fatty diamine oleate 61791-53-5 | 0.99% | 4.95% | 0.99% | 0.2475 | 0.99% | 0.2475 | 0.2475 |
| tallow diamine 61791-55-7 | 0.005 | 0.025 | 0.005 | 0.00125 | 0.005 | 0.00125 | 0.00125 |
| oleic acid 112-80-1 | 0.005 | 0.025 | 0.005 | 0.00125 | 0.005 | 0.00125 | 0.00125 |
| Perchloroethylene (tetrachloroethylene) CAS# 127-18-4 | 0 | 0 | 45.20% | 43.95% | 0 | 0 | 0 |
| Parachlorobenzotrifluoride (98-5-6) | 41.82% | 40.20% | 0 | 0 | 45.20% | 43.95% | 43.95% |
| King K-Corr ® NF 200 | 0.10% | 0.10% | 0.10% | 0.10% | 0.10% | 0.10% | 0.10% |
| benzotriazole (unknown CAS#) | 0.10% | 0.10% | 0.10% | 0.10% | 0.10% | 0.10% | 0.10% |
| King CA/W1146 (composition below): | 10% | 10% | 10% | 12% | 10% | 12% | 12% |
| calcium sulfonate 61789-86-4 | 2.8 | 2.8 | 2.8 | 3.36% | 2.8 | 3.36% | 3.36 |
| calcium carbonate 1317-65-3 | 0.8 | 0.8 | 0.8 | 0.96% | 0.8 | 0.96% | 0.96 |
| corrosion inhibitor (carrier oil -CAS # unknown) | 6.4 | 6.4 | 6.4 | 8% | 6.4 | 8% | 7.68 |
| King AW-6110 (composition below): | 1% | 1% | 1% | 1% | 1% | 1% | 1% |
| alkyl phosphate amine salts (mixture) | 1% | 1% | 1% | 1% | 1% | 1% | 1% |
| aerosol nano diamond concentrate | 3.38% | 0 | 0 | 0 | 0 | 0 | 0% |
| can size | 16 oz | 16 oz | 12 oz | 16 oz | 12 oz | 16 oz and 8 oz | 16 oz |
| Aerosol Product label wt. | 13 oz | 13 oz | 10.6 oz | 13 oz | 9 oz | 12 oz and 7.3 oz | 12 oz |
| $CO_2$ fill wt | .20 OZ | 0.20 OZ | 0.25 | .32 oz | 0.25 oz | .32 oz and .20 oz | .20 OZ |

Example 9

This example illustrates the corrosion-inhibiting properties of lubricants of the present teachings.

Figure 6:
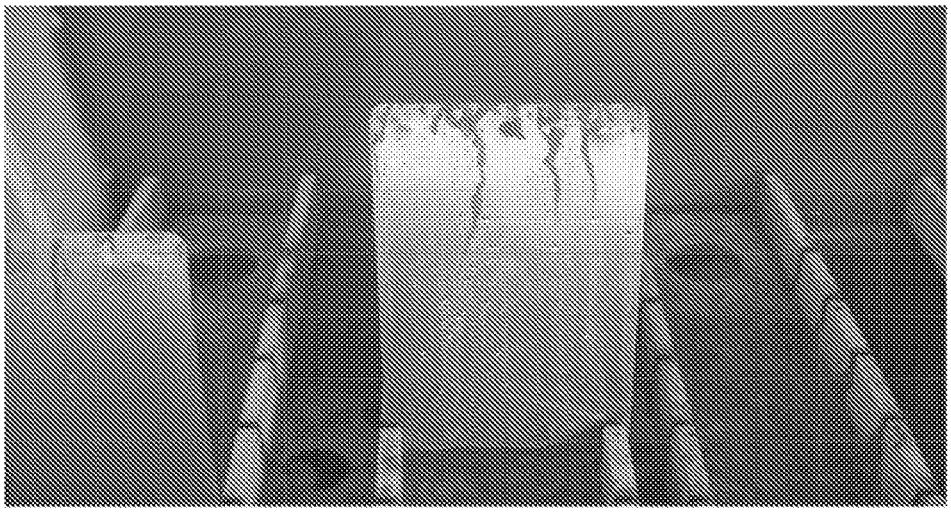
FIG. 6 illustrates salt fog test after 192 hours for Q20, a formulation of the present teachings.

Lubricant compositions were prepared according to Examples 1-4. Metal plates were then coated with lubricant composition and placed in a salt (fog) chamber for testing under ASTM B117 standards. FIG. 1-5 illustrate corrosion-inhibition properties of lubricant compositions of commercial lubricant/corrosion inhibitors and, in FIG. 2-5, corrosion-inhibition properties of the Q20 formulation of the present teachings tested simultaneously with commercial lubricant/corrosion inhibitors. FIG. 6 illustrates corrosion appearing in a Q20-treated metal plate subjected to test conditions for 192 hours under ASTM B11 standards. These experiments illustrate that corrosion did not become apparent until a time greater than 150 hours in Q20-treated plates, whereas corrosion appeared far sooner with commercial corrosion inhibitor/lubricants.

Example 10

This example illustrates wear scar tests (ASTM D 148, a test under the standards of ASTM International, formerly the American Society for Testing and Materials) of lubricants of the present teachings and commercially available lubricants. The ASTM D 148 test method is used to evaluate the relative abilities of metal preservatives to prevent the rusting of steel panels under conditions of 100% relative humidity at 50 degrees Celsius. This test is not as severe as the Salt Spray Test. It is not uncommon for test panels to run well over 1,000 hours before the onset of rust.

In this example, steel panels are prepared to a prescribed surface finish, dipped in the test fluid, allowed to drain and then suspended in the humidity cabinet. A continuous supply of air is delivered to the cabinet which is maintained at 50 degrees Celsius. Panels are periodically checked for signs of rust. A failure occurs at the point in time when either a rust spot larger than 1 mm in diameter appears or four rust spots of any size are observed. Results are reported as hours to failure.

The following wear scar test results were obtained for both some disclosed formulations as well as some commercially available lubricants.

TABLE 9

| Results of wear scar tests. | |
|---|---|
| Product | Scar (mm) Lower is better |
| Q20 Industrial Strength of the present teachings | 0.55 |

TABLE 9-continued

Results of wear scar tests.

| Product | Scar (mm) Lower is better |
|---|---|
| Q20 Retail Multipurpose of the present teachings | 0.6 |
| CRC Industrial Strength | 0.71 |
| Liquid WRENCH ® Penetrating Oil | 0.6 |
| ZEP 45 ™ PENETRATING LUBRICANT | 0.65 |
| WD-40 ® | 0.8 |
| CLP | 0.6 |
| LPS 3 ® - Heavy Duty Rust Inhibitor | 0.65 |
| Boeshield T-9 ® | 1.0 |
| Blaster Penetrating | 0.8 |
| Remington Rem ® Oil | 0.85 |

These data demonstrate that a lubricant formulation of the present teachings can exhibit wear properties equal or superior to commercially available lubricants.

Example 11

This example illustrates salt spray test (ASTM B 117).

The ASTM B 117 Salt Spray Test, also referred to as the Salt Fog Test, offers an accelerated method to differentiate the rust prevention characteristics afforded by a coating. For example, failure (rusting) can occur in a few hours for a thin, oily coating or in thousands of hours for a thick hard coating.

Often used as a screening test due to the speed at which results can be obtained, an aqueous solution of 5% sodium chloride is continuously sprayed in the cabinet engulfing the test panels which creates an environment conducive to corrosion.

Test Procedure: The test apparatus consists of a cabinet capable of maintaining a temperature of 35° C. where pressure and the introduction of the salt containing vapors (spray) can be controlled. Test panels are set on internal racks and are subjected to the salt fog atmosphere for variable amounts of time.

Results are reported as the number of hours to failure (onset of rust).

TABLE 10

Results of salt spray tests.

| Product | Hours Salt Fog 0-20% Rust (hrs to failure) Higher is Better |
|---|---|
| Q20 Industrial Strength of the present teachings | 168 |
| Q20 Retail Multipurpose of the present teachings | 120 |
| CRC Industrial Strength | 96 |
| Liquid WRENCH ® Penetrating Oil | 72 |
| ZEP 45 PENETRATING LUBRICANT | 72 |
| WD-40 ® | 72 |
| CLP | 48 |
| LPS 3 ® - Heavy Duty Rust Inhibitor | 48 |
| Boeshield T-9 ® | 48 |
| Blaster Penetrating | 24 |
| Remington Rem ® Oil | 24 |

These data demonstrate that a lubricant formulation of the present teachings can exhibit rust prevention characteristics equal or superior to commercially available lubricants.

Example 12

This example presents comparisons between commercially available WD-40® lubricant and formulations of the present teachings, tested using standard ASTM tests. The data are results obtained under our experimental conditions. Because results can vary with experimental configurations, our measured values do not always duplicate those stated by the manufacturer of WD-40®.

TABLE 11

ASTM tests comparing WD-40 ® with compositions of the present teachings.

| | ASTM Test | | | |
|---|---|---|---|---|
| | ASTM-4172 (Four Ball method for wear preventive characteristics) | ASTM-3233 (Falex Pin & Vee method for antiwear and extreme pressure characteristics) | ASTM D-5620A (endurance (wear) life and load carrying capacity of thin film fluid lubricant) | ASTM B-117 (Salt Spray Apparatus) |
| Test Description | "Lubricates and Protects" Lower # Better | "Extreme Pressure" Higher # Better | "Long Lasting Duration" Longer is Better | "Corrosion Protection" |
| Product WD-40 ® Range | (stated as 0.60-0.82 mm*) tested 0.75 mm | (stated as 1100-1500 lbs*) tested 1070 lbs | (stated as 1-10 min at 300 lbs*) tested 1-4 min | 0-20% Rust at 72 hours |
| Q-20 G Sample Consumer Product | 0.65 & 0.70 mm | 1170 lbs | 2-4 min at 300 lbs | 0-20% Rust at 168 hours |
| Q-20 G Sample Industrial Product | 0.55-0.60 mm | 1200 lbs | 2-4 min at 300 lbs | 0-20% Rust at 192 hours |

*Manufacturer's specification

Our data indicate that under our experimental conditions, lubricant formulations of the present teachings gave results similar or superior to WD-40® for lubricant properties tested in ASTM Tests ASTM-4172, ASTM-3233, ASTM D-5620A and ASTM B-117.

Example 13

This example presents a water displacement test comparing WD-40® and Q20 formulation of the present teachings (right).

Figure 7:
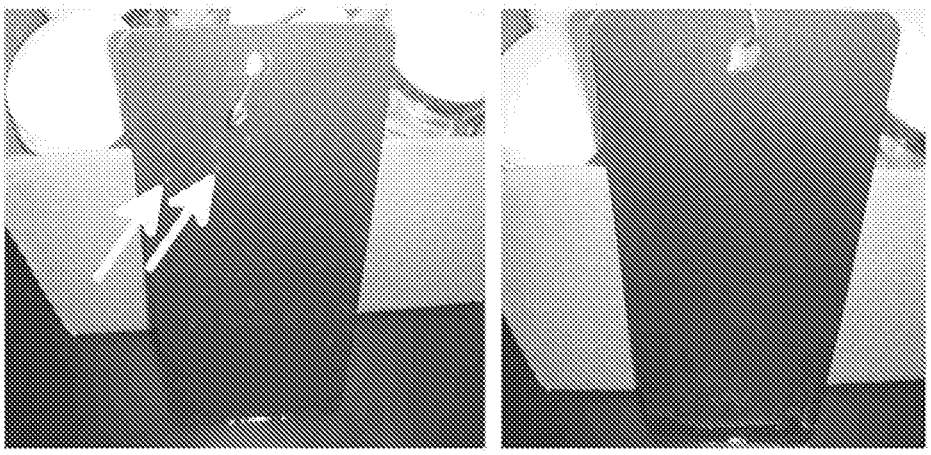
FIG. 7 illustrates a water displacement test in which a panel is sprayed with water, then with WD-40® (left) or Q20, a formulation of the present teachings (right), wherein spots are seen following WD-40® (arrows).

In these experiments, illustrated in FIG. 7, a panel is sprayed with water then with WD-40® (left) or Q20 (right) (after 3 minutes). Arrows indicate examples of spots that appear on the WD-40® surface.

All references cited herein are incorporated by reference, each in its entirety.

What is claimed is:

1. A lubricant composition comprising:
a) about 15 to about 25 wt % of a mineral oil;
b) about 17 to about 27 wt % of a petroleum hydrocarbon;
c) about 5 to about 15 wt % of a liquid wax;
d) about 40 to about 50 wt % of a halogenated organic solvent;
e) about 0.5 to about 1.5 wt % of phosphoric acid esters;
f) about 0.05, to about 0.15 wt % of a metal deactivator; and
g) about 0.05 to about 6.0 wt % of an N-tallow alkyl-1,3-diaminopropane dioleate surfactant.

2. A lubricant composition in accordance with claim 1, wherein the about 0.05 to about 6.0 wt % of an N-tallow alkyl-1,3-diaminopropane dioleate surfactant is about 0.05 to 1.5 wt % of an N-tallow alkyl-1,3-diaminopropane dioleate surfactant.

3. A lubricant composition in accordance with claim 1, further comprising h) about 1 to about 10 wt % of a nano diamond component that is a nano diamond powder or a 90 to 99% nano diamond concentrate.

4. A lubricant composition in accordance with claim 1, wherein
a) the about 15 to about 25 wt % of a mineral oil is about 21 wt % of a hydrotreated heavy naphthenic distillate;
b) the about 17 to about 27 wt % of a petroleum hydrocarbon is about 22.7 wt % of a kerosene;
c) the about 5 to about 15 wt % of a liquid wax is about 10.0 wt % of a liquid wax comprising a mixture of at least one calcium alkylarylsulfonate, at least one calcium carboxylate and a plurality of petroleum oxidates;
d) the about 40 to about 50 wt % of a halogenated organic solvent is about 40.2 wt % of parachlorobenzotrifluoride;
e) the about 0.5 to about 1.5 wt % of phosphoric acid esters is about 1.0 wt % of amine salts of aliphatic phosphoric acid esters;
f) the about 0.05 to about 0.15 wt % of a metal deactivator is about 0.1 wt % of a benzotriazole metal deactivator; and
g) the about 0.05 to about 6.0 wt % of an N-tallow alkyl-1,3-diaminopropane dioleate surfactant is about 5.0 wt % of an N-tallow alkyl-1,3-diaminopropane dioleate surfactant.

5. A lubricant composition in accordance with claim 1, wherein
a) the mineral oil comprises a hydrotreated heavy naphthenic distillate;
b) the petroleum hydrocarbon comprises a kerosene;
c) the liquid wax comprises a mixture of at least one calcium alkylarylsulfonate, at least one calcium carboxylate and a plurality of petroleum oxidates;
d) the halogenated organic solvent comprises parachlorobenzotrifluoride or perchloroethylene;
e) the phosphoric acid esters comprise amine salts of aliphatic phosphoric acid esters;
and
f) the metal deactivator comprises a benzotriazole metal deactivator.

6. A lubricant composition in accordance with claim 1, further comprising h) about 1 to about 10 wt. % of a nano diamond component comprising nano diamond particles having an average diameter of from about 4 to about 6 nm.

7. A lubricant composition in accordance with claim 5, wherein:
a) the hydrotreated heavy naphthenic distillate is about 20 wt % of a hydrotreated heavy naphthenic distillate;
b) the kerosene is about 22.7 wt % of a kerosene;
c) the liquid wax is about 12 wt % of a liquid wax comprising a mixture of at least one calcium alkylarylsulfonate, at least one calcium carboxylate and a plurality of petroleum oxidates;
d) the halogenated organic solvent is about 43.95 wt % of parachlorobenzotrifluoride;
e) the amine salts of aliphatic phosphoric acid esters are about 1.0 wt % of amine salts of aliphatic phosphoric acid esters;
f) the benzotriazole metal deactivator is about 0.1 wt % of a benzotriazole metal deactivator; and
g) the N-tallow alkyl-1,3-diaminopropane dioleate surfactant is about 0.25 wt % of an N-tallow alkyl-1,3-diaminopropane dioleate surfactant.

8. A lubricant composition in accordance with claim 5, wherein:
a) the about 15 to about 25 wt % of a mineral oil is about 20 wt % of a hydrotreated heavy naphthenic distillate;
b) the about 17 to about 27 wt % of a petroleum hydrocarbon is about 22.7 wt % of a kerosene;
c) the about 5 to about 15 wt % of a liquid wax is about 10 wt % of a liquid wax comprising a mixture of at least one calcium alkylarylsulfonate, at least one calcium carboxylate and a plurality of petroleum oxidates;
d) the about 40 to about 50 wt % of a halogenated organic solvent is about 41.82 wt % of parachlorobenzotrifluoride;
e) the about 0.5 to about 1.5 wt % of phosphoric acid esters is about 1.0 wt % of amine salts of aliphatic phosphoric acid esters;
f) the about 0.05 to about 0.15 wt % of a metal deactivator is about 0.1 wt % of a benzotriazole metal deactivator;
g) the about 0.05 to about 6.0 wt % of an N-tallow alkyl-1,3-diaminopropane dioleate surfactant is about 1.0 wt % of an N-tallow alkyl-1,3-diaminopropane dioleate surfactant; and
wherein the composition further comprises h) about 3.4 wt. % of a nano diamond component.

9. A lubricant composition in accordance with claim 5, wherein:
a) the hydrotreated heavy naphthenic distillate is about 20 wt % of a hydrotreated heavy naphthenic distillate;
b) the kerosene is about 22.7 wt % of a kerosene;
c) the liquid wax is about 10 wt % of a liquid wax comprising a mixture of at least one calcium alkylarylsulfonate, at least one calcium carboxylate and a plurality of petroleum oxidates;
d) the perchloroethylene is about 45.2 wt % of perchloroethylene;
e) the amine salts of aliphatic phosphoric acid esters are about 1.0 wt % of amine salts of aliphatic phosphoric acid esters;
f) the benzotriazole metal deactivator is about 0.1 wt % of a benzotriazole metal deactivator; and
g) the N-tallow alkyl-1,3-diaminopropane dioleate surfactant is about 1.0 wt % of an N-tallow alkyl-1,3-diaminopropane dioleate surfactant.

10. A lubricant composition in accordance with claim 5, wherein:

a) the hydrotreated heavy naphthenic distillate is about 20 wt % of a hydrotreated heavy naphthenic distillate;
b) the kerosene is about 22.7 wt % of a kerosene;
c) the liquid wax is about 12 wt % of a liquid wax comprising a mixture of at least one calcium alkylarylsulfonate, at least one calcium carboxylate and a plurality of petroleum oxidates;
d) the perchloroethylene is about 43.95 wt % of perchloroethylene;
e) the amine salts of aliphatic phosphoric acid esters are about 1.0 wt % of amine salts of aliphatic phosphoric acid esters;
f) the benzotriazole metal deactivator is about 0.1 wt % of a benzotriazole metal deactivator; and
g) the N-tallow alkyl-1,3-diaminopropane dioleate surfactant is about 0.25 wt % of an N-tallow alkyl-1,3-diaminopropane dioleate surfactant.

11. A lubricant composition in accordance with claim 5, wherein:
a) the hydrotreated heavy naphthenic distillate is about 20 wt % of a hydrotreated heavy naphthenic distillate;
b) the kerosene is about 22.7 wt % of a kerosene;
c) the liquid wax is about 10 wt % of a liquid wax comprising a mixture of at least one calcium alkylarylsulfonate, at least one calcium carboxylate and a plurality of petroleum oxidates;
d) the halogenated organic solvent is about 45.2 wt % of parachlorobenzotrifluoride;
e) the amine salts of aliphatic phosphoric acid esters are about 1.0 wt % of amine salts of aliphatic phosphoric acid esters;
f) the benzotriazole metal deactivator is about 0.1 wt % of a benzotriazole metal deactivator; and
g) the N-tallow alkyl-1,3-diaminopropane dioleate surfactant is about 1.0 wt % of an N-tallow alkyl-1,3-diaminopropane dioleate surfactant.

12. A lubricant composition in accordance with claim 5, wherein:
a) the hydrotreated heavy naphthenic distillate is about 20 wt % of a hydrotreated heavy naphthenic distillate;
b) the kerosene is about 22.7 wt % of a kerosene;
c) the liquid wax is about 12 wt % of a liquid wax consisting of a mixture of at least one calcium alkylarylsulfonate CAS #61789-86-4, at least one calcium carboxylate and a plurality of petroleum oxidates;
d) the parachlorobenzotrifluoride is about 43.95 wt % of parachlorobenzotrifluoride;
e) the amine salts of aliphatic phosphoric acid esters are about 1.0 wt % of amine salts of aliphatic phosphoric acid esters;
f) the benzotriazole metal deactivator is about 0.1 wt % of a benzotriazole metal deactivator; and
g) the N-tallow alkyl-1,3-diaminopropane dioleate surfactant is about 0.25 wt % of an N-tallow alkyl-1,3-diaminopropane dioleate surfactant.

13. A lubricant composition in accordance with claim 1, wherein the halogenated organic solvent is selected from the group consisting of parachlorobenzotrifluoride and perchloroethylene.

14. A lubricant composition in accordance with claim 1, wherein the lubricant yields <0.6 mm scar in an ASTM D 148 wear scar test.

15. A lubricant composition in accordance with claim 7, wherein the lubricant composition yields about 0.55 mm scar in an ASTM D 148 wear scar test.

16. A lubricant composition in accordance with claim 1, wherein the lubricant exhibits >96 hrs to failure in an ASTM B 117 Salt Spray Test.

17. A lubricant composition in accordance with claim 10, wherein the lubricant composition exhibits about 120 hrs to failure, or greater than about 120 hrs to failure in an ASTM B 117 Salt Spray Test.

18. An apparatus containing a lubricant composition for aerosol delivery, said apparatus comprising:
a container;
a lubricant composition of claim 3 contained therein;
a propellant, and
an actuating valve for discharging the composition in the container in an aerosol form.

19. An apparatus containing a lubricant composition for aerosol delivery, said apparatus comprising:
a container;
a lubricant composition of claim 1 contained therein;
a propellant, and
an actuating valve for discharging the composition in the container in an aerosol form.

20. An apparatus in accordance with claim 19, wherein the propellant is carbon dioxide.

* * * * *